US008585866B2

(12) United States Patent
Mikami et al.

(10) Patent No.: US 8,585,866 B2
(45) Date of Patent: Nov. 19, 2013

(54) WIRE FOR PAPERMAKING OF MICROFIBROUS CELLULOSE-CONTAINING SHEET AND METHOD FOR PRODUCING MICROFIBROUS CELLULOSE-CONTAINING SHEET

(75) Inventors: Eiichi Mikami, Tokyo (JP); Yusuke Kohara, Tokyo (JP); Takashi Kawamukai, Tokyo (JP); Yasutomo Noishiki, Tokyo (JP)

(73) Assignee: Oji Holdings Corporation, Tokyo (JP)

( * ) Notice: Subject to any disclaimer, the term of this patent is extended or adjusted under 35 U.S.C. 154(b) by 0 days.

(21) Appl. No.: 13/811,099

(22) PCT Filed: Jul. 22, 2011

(86) PCT No.: PCT/JP2011/066680

§ 371 (c)(1),
(2), (4) Date: Jan. 18, 2013

(87) PCT Pub. No.: WO2012/011559

PCT Pub. Date: Jan. 26, 2012

(65) Prior Publication Data

US 2013/0112361 A1 May 9, 2013

(30) Foreign Application Priority Data

Jul. 23, 2010 (JP) ..... 2010-166045
Jul. 23, 2010 (JP) ..... 2010-166046
Sep. 1, 2010 (JP) ..... 2010-196001

(51) Int. Cl.
*D21F 11/00* (2006.01)

(52) U.S. Cl.
USPC ..... 162/202

(58) Field of Classification Search
USPC ..... 162/202, 289
See application file for complete search history.

(56) References Cited

U.S. PATENT DOCUMENTS

| | | | | | |
|---|---|---|---|---|---|
| 1,651,476 | A | * | 12/1927 | Sheehan | 162/359.1 |
| 2,992,469 | A | * | 7/1961 | Hose et al. | 245/8 |
| 3,137,613 | A | * | 6/1964 | Buckman et al. | 162/199 |
| 3,177,113 | A | * | 4/1965 | Golden et al. | 245/8 |
| 3,199,989 | A | * | 8/1965 | Buckman et al. | 106/14.15 |
| 3,346,466 | A | * | 10/1967 | Golden et al. | 205/138 |
| 3,425,900 | A | * | 2/1969 | Purdy | 162/348 |
| 2003/0075059 | A1 | * | 4/2003 | Mori | 101/127 |
| 2003/0129381 | A1 | * | 7/2003 | Mori | 428/315.5 |

(Continued)

FOREIGN PATENT DOCUMENTS

| | | |
|---|---|---|
| JP | A-05-148387 | 6/1993 |
| JP | A-08-188980 | 7/1996 |

(Continued)

OTHER PUBLICATIONS

International Search Report issued in corresponding International Application No. PCT/JP2011/066680 on Aug. 30, 2011.

*Primary Examiner* — Mark Halpern
(74) *Attorney, Agent, or Firm* — Knobbe Martens Olson & Bear LLP

(57) ABSTRACT

A wire for papermaking of a microfibrous cellulose-containing sheet includes a base that has water permeability and a porous coating layer that is provided on at least one surface of the base, wherein the porous coating layer contains a porous pigment, an adhesive and a hydrophobizing agent.

13 Claims, 5 Drawing Sheets

(56) References Cited

U.S. PATENT DOCUMENTS

| | | | | |
|---|---|---|---|---|
| 2005/0037681 | A1* | 2/2005 | FitzPatrick | 442/77 |
| 2007/0207692 | A1 | 9/2007 | Ono et al. | |
| 2007/0218279 | A1* | 9/2007 | Nonaka et al. | 428/365 |

FOREIGN PATENT DOCUMENTS

| | | | |
|---|---|---|---|
| JP | A-10-140493 | | 5/1998 |
| JP | B-3036354 | | 4/2000 |
| JP | A-2001-279016 | | 10/2001 |
| JP | A-2006-193858 | | 7/2006 |
| JP | A-2006-316253 | | 11/2006 |
| JP | A-2007-023218 | | 2/2007 |
| JP | A-2008-274525 | | 11/2008 |
| JP | A-2011-042903 | | 3/2011 |
| WO | WO 2006/004012 | A1 | 1/2006 |
| WO | WO 2010/073678 | A1 | 7/2010 |
| WO | WO 2011/010609 | A1 | 1/2011 |
| WO | WO 2011/093510 | A1 | 8/2011 |

* cited by examiner

WIRE FOR PAPERMAKING OF MICROFIBROUS CELLULOSE-CONTAINING SHEET AND METHOD FOR PRODUCING MICROFIBROUS CELLULOSE-CONTAINING SHEET

This application is the U.S. National Phase under 35 U.S.C. §371 of International Application PCT/JP2011/066680, filed Jul. 22, 2011, designating the U.S., and published in Japanese as WO 2012/011559 on Jan. 26, 2012, which claims priority to Japanese Patent Application No. 2010-166045, filed Jul. 23, 2010; Japanese Patent Application No. 2010-166046, filed Jul. 23, 2010; and Japanese Patent Application No. 2010-196001, filed Sep. 1, 2010, the entire contents of which are incorporated herein by reference.

TECHNICAL FIELD

The present invention relates to providing a wire for papermaking which is used when microfibrous cellulose is formed into a sheet by a papermaking method and a method for producing a microfibrous cellulose-containing sheet using the wire for papermaking.

Priority is claimed on Japanese Patent Application No. 2010-166045, Japanese Patent Application No. 2010-166046, filed Jul. 23, 2010, and Japanese Patent Application No. 2010-196001, filed Sep. 1, 2010, the contents of which are incorporated herein by reference.

BACKGROUND ART

In recent years, since substitution of petroleum resources and environmental consciousness have been increased, there has been a focus on materials using recyclable natural fibers. Among the natural fibers, a cellulose fiber having a fiber diameter of 10 to 50 μm, particularly, cellulose fiber (pulp) derived from a tree has been widely used mainly as a paper product so far.

As for the cellulose fiber, microfibrous cellulose has also been known having a fiber diameter of equal to or less than 1 μm. A sheet containing the microfibrous cellulose has advantages such as high mechanical strength and high air permeability and the application is considered for various purposes.

As a method for producing a microfibrous cellulose-containing sheet, in PTLs 1 to 3, papermaking from microfibrous cellulose using a wire for papermaking in the related art is disclosed. However, since the microfibrous cellulose cannot be sufficiently trapped by using the wire for papermaking in this method, sufficient filtering efficiency cannot be obtained and the yield rate is low. In particular, microfibrous cellulose having an average fiber diameter of 2 to 200 nm and an average fiber length of 0.01 to 100 μm can be hardly trapped by the wire for papermaking in the related art and cannot be formed into a sheet.

In PTLs 4 to 6, a method in which a microfibrous cellulose suspension is flow-casted into glass, a resin plate, a metal plate and the like and dried to be formed into a sheet is disclosed. However, this method requires energy and time for drying when forming the sheet and included increased costs.

In PTLs 7 and 8, there is suggestion that a filter fabric having compactness (a predetermined range of air permeability), a non-woven fabric including organic polymer fiber, a textile, or a porous membrane filter fabric including an organic polymer is used as a wire for papermaking in order to industrially produce a microfibrous cellulose-containing sheet. However, the filter fabric, textile and non-woven fabric cannot sufficiently trap microfibrous cellulose and the yield rate is low. In addition, since recycling is difficult and is expensive after the filter fabric, textile and non-woven fabric are used in filtering once, the filter fabric, textile and non-woven fabric are disposable, and manufacturing costs are increased. When the filter fabric, textile and non-woven fabric are used as the wire for papermaking, the surface quality of the obtained microfibrous cellulose-containing sheet is insufficient.

In addition, while a method for using filter paper having a large number of pores, or a membrane filter which is a film-shaped filter and the like is known, as a method in which the microfibrous cellulose suspension is filtered, dehydrated and formed into a sheet, there is a tendency to easily cause clogging due to the microfibrous cellulose and an increase of filtration time.

CITATION LIST

Patent Literature

[PTL 1] Japanese Patent No. 3036354

[PTL 2] Japanese Unexamined Patent Application, First Publication No. H10-140493

[PTL 3] Japanese Unexamined Patent Application, First Publication No. H8-188980

[PTL 4] Japanese Unexamined Patent Application, First Publication No. H5-148387

[PTL 5] Japanese Unexamined Patent Application, First Publication No. 2001-279016

[PTL 6] Japanese Unexamined Patent Application, First Publication No. 2007-23218

[PTL 7] Japanese Unexamined Patent Application, First Publication No. 2006-193858

[PTL 8] PCT International Publication No. WO2006/004012

SUMMARY OF INVENTION

Technical Problem

An object of the present invention is to provide a wire for papermaking, which has sufficiently high water resistance and/or a high yield rate, while achieving high productivity, and is capable of producing a microfibrous cellulose-containing sheet having a favorable surface quality at a low cost, and a method for producing a microfibrous cellulose-containing sheet.

Solution to Problem

The present invention is configured as follows:

[1] A wire for papermaking of a microfibrous cellulose-containing sheet including a base that has water permeability; and a porous coating layer that is provided on at least one surface of the base.

[2] The wire for papermaking of a microfibrous cellulose-containing sheet according to [1], wherein the base that has water permeability is a water resistance base.

[3] The wire for papermaking of a microfibrous cellulose-containing sheet according to [1], wherein the base that has water permeability is a paper base.

[4] The wire for papermaking of a microfibrous cellulose-containing sheet according to any one of [1] to [3], wherein the porous coating layer contains a porous pigment and an adhesive.

[5] The wire for papermaking of a microfibrous cellulose-containing sheet according to [4], wherein the porous coating layer further contains a hydrophobizing agent.

[6] The wire for papermaking of a microfibrous cellulose-containing sheet according to [5], wherein the hydrophobizing agent is at least one selected from a group consisting of silicone compounds, fluorine compounds, polyolefin waxes, higher fatty acid amides, higher fatty acid alkali salts, and acrylic-based polymers.

[7] The wire for papermaking of a microfibrous cellulose-containing sheet according to [5] or [6], wherein the hydrophobizing agent is unevenly distributed to an exposed surface of the porous coating layer.

[8] The wire for papermaking of a microfibrous cellulose-containing sheet according to any one of [4] to [7], wherein a content of the adhesive in the porous coating layer is 5 to 100 parts by mass with respect to 100 parts by mass of the porous pigment.

[9] The wire for papermaking of a microfibrous cellulose-containing sheet according to any one of [1] to [8], wherein the porous coating layer contains a pigment consisting of secondary particles as the porous pigment, and respectively has one or more peaks on a pore diameter distribution curve measured by a mercury press-in method in ranges of pore diameters of equal to or less than 0.1 μm and 0.2 to 20 μm.

[10] The wire for papermaking of a microfibrous cellulose-containing sheet according to any one of [1] to [8], wherein the porous coating layer contains a pigment consisting of secondary particles as the porous pigment, and substantially has a peak on a pore diameter distribution curve measured by a mercury press-in method only in a range of a pore diameter of equal to or less than 0.1 μm.

[11] A method for producing a microfibrous cellulose-containing sheet including the steps of:

filtering and dehydrating a suspension containing microfibrous cellulose and water using the wire for papermaking of a microfibrous cellulose-containing sheet according to any one of [1] to [10] to obtain a hydrous web; and drying the hydrous web.

[12] The method for producing a microfibrous cellulose-containing sheet according to [11], wherein the suspension contains a resin emulsion.

Advantageous Effects of Invention

According to the wire for papermaking and the method for producing a microfibrous cellulose-containing sheet of the present invention, sufficient high water resistance is achieved, clogging does not easily occur while sufficiently trapping a microfibrous cellulose, yield rate can be increased while achieving high productivity, and a microfibrous cellulose-containing sheet having favorable surface quality can be produced at a low cost.

DESCRIPTION OF EMBODIMENTS

<Wire for Papermaking of Microfibrous Cellulose-Containing Sheet>

A wire for papermaking of a microfibrous cellulose-containing sheet of the present invention (hereafter, abbreviated to "wire for papermaking") is used when a suspension containing microfibrous cellulose (hereafter, refer to "microfibrous cellulose suspension") is filtered and dehydrated to produce a microfibrous cellulose-containing sheet, and includes a base 201 (for example, water resistance base and paper base) and a porous coating layer 200 provided on at least one surface of the base 201.

Figure 4:
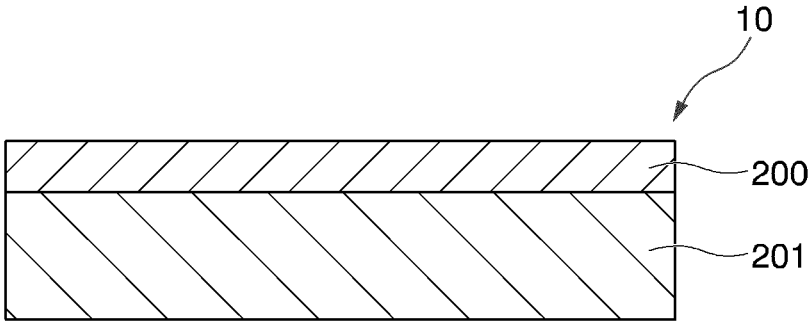
FIG. 4 is a schematic cross-sectional view of a wire of the present invention.
Figure 5:
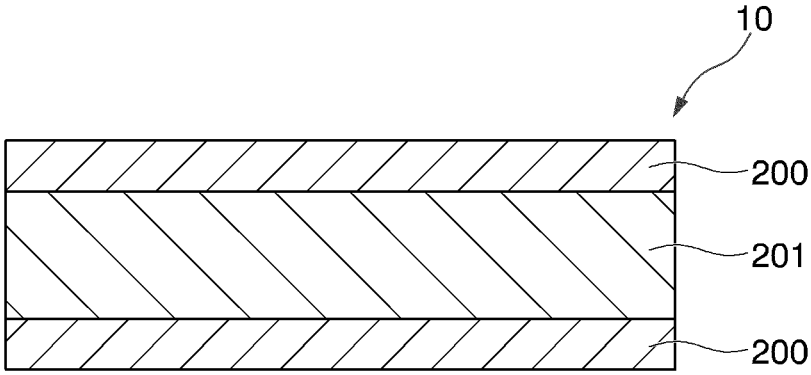
FIG. 5 is a schematic cross-sectional view of another wire of the present invention.
Figure 6:
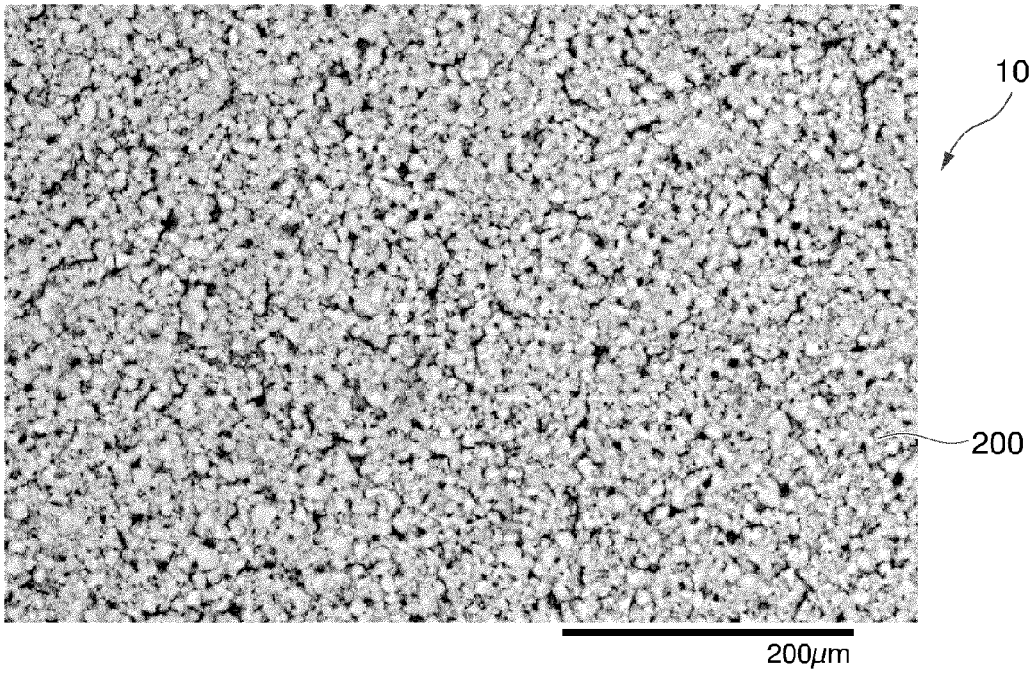
FIG. 6 is a backscattered electron image in which a surface of a porous coating layer configuring the wire of the present invention is magnified 200 times.

As shown in FIG. 4, the porous coating layer 200 may be provided on only one surface of the base 201 or on both surfaces thereof, as shown in FIG. 5. When the porous coating layer 200 is provided on only one surface, it is economical.

(Base)

The base has water permeability. Specifically, examples of the base having water permeability include a paper base and a water resistance base (a metal wire, organic fiber woven fabric, inorganic fiber woven fabric, organic fiber non-woven fabric, and inorganic fiber non-woven fabric).

Figure 1:
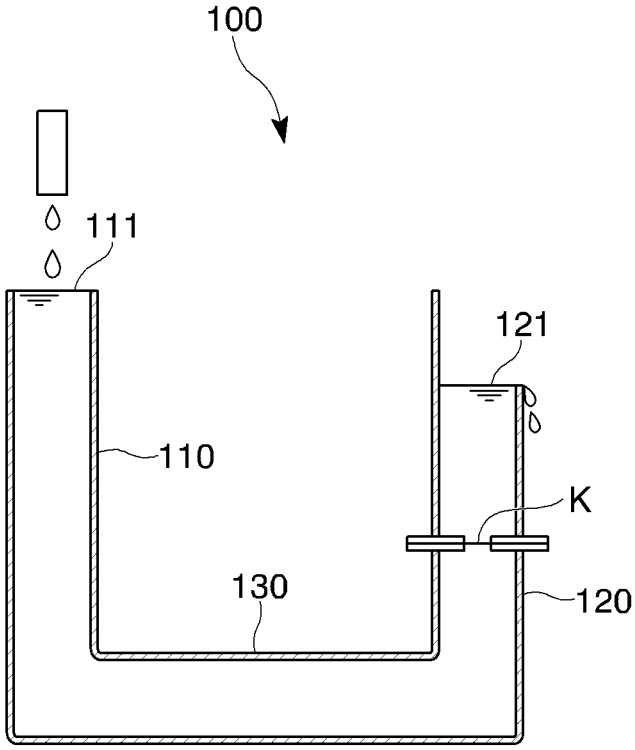
FIG. 1 is a schematic configuration view of an example of a water permeability measuring apparatus.

The water permeability of the water resistance base is measured by a measuring apparatus 100 shown in FIG. 1 according to JIS A 1218. The water permeability measuring apparatus 100 includes a first pipe 110 and a second pipe 120 disposed in a vertical direction, and a horizontal connecting pipe 130 connecting a lower portion of the first pipe 110 and a lower portion of the second pipe 120. In addition, an upper end 111 of the first pipe 110 is opened so that water can be supplied and an upper end 121 of the second pipe 120 is opened so that water can flow out. The position of the upper end 111 of the first pipe 110 is higher than that of the upper end 121 of the second pipe 120 by 10 cm. A test piece of the water resistance base K is horizontally attached to the second pipe 120 so as to block the inside thereof. A contact area of water and the water resistance base K is set to 1 $cm^2$.

In the water permeability measurement, the test piece of the water resistance base K which is made so as to have a sufficient affinity with water is attached to the inside of the second pipe 120, water is filled in the first pipe 110, the second pipe 120 and the connecting pipe 130, and then, water is supplied to the upper end 111 of the first pipe 110. When the water resistance base K has water permeability, the water passes through the water resistance base K and flows out from the upper end 121 of the second pipe 120. A value of a permeability coefficient [cm/second] can be obtained such that water is supplied for 60 seconds, an amount of water flowing out at that time is measured, and is calculated using the following equation. The value of the permeability coefficient is preferably 0.0005 to 10.0 cm/second and more preferably 0.01 to 0.5 cm/second.

$$\text{Permeability coefficient [cm/second]} = (\text{thickness of water resistance base [cm]} \times \text{outflow water amount [cm}^3\text{]})/(10\ [\text{cm}] \times 1[\text{cm}^2] \times 60\ [\text{seconds}])$$

[Paper Base]

There is no particular limitation to the paper base and for example, high quality paper, middle quality paper, copy paper, art paper, coated paper, kraft paper, paperboard, white board, newsprint paper, woody paper and the like can be used.

Examples of pulps which are used as main components of the paper bases include chemical pulps such as LBKP, LNBKP, NBKP, LUKP, NUKP, SP and CP, mechanical pulp such as GP, TMP and CGP, and waste paper recycling pulp. The pulp may be used singly or in combination of two or more kinds.

Examples of waste paper which is a raw material of the waste paper recycling pulp include, waste newsprint paper, waste magazine paper, waste paperboard, waste wrapping paper, waste corrugated paperboard, waste print paper, and waste communication paper. In addition, maculature generated during papermaking may be used.

The waste paper recycling pulp can be obtained through a defiberizing step of forming the waste paper and the maculature into a low concentration pulp or high concentration pulp, a roughing step and a selecting step using a screen or a cleaner, a deinking step using a flotation method or a water cleaning method, a bleaching step using chlorine bleaching, chlorine dioxide bleaching, sodium hypochlorite bleaching, oxygen bleaching and the like.

Among the paper bases, a loading material may be blended other than the above pulps. As for the loading material, for example, clay, kaolin, calcined kaolin, talc, calcium carbonate, magnesium carbonate, aluminum hydroxide, calcium hydroxide, silica, titanium oxide and the like are appropriately used.

In addition, the paper base may contain a wet paper strengthening agent, and a dry paper strengthening agent to improve water resistance.

In order to produce the paper base in which the water resistance is improved, a method in which the wet paper strengthening agent is added to a raw material slurry before papermaking to make paper, and a method in which the dry paper strengthening agent is added to a raw material slurry before papermaking to make paper, and a method in which the dry paper strengthening agent is applied to a surface using a method such as a size press after papermaking, and the like can be used.

Examples of the wet paper strengthening agents which give water resistance include melamine-formaldehyde resins, urea formaldehyde resins, epoxidized polyamide-polyamine resins, and polyethyleneimines.

Examples of the dry paper strengthening agents include raw starches such as corn starch, tapioca starch, and potato starch, or processed starch to which chemical modification is added, plant gums, and polyacrylamides.

As the method for papermaking when the paper base is obtained, known paper machines such as a Fourdrinier paper machine, a cylinder paper machine, a twin-wire paper machine, or a multilayer combination paper machine which is a combination thereof can be used for production.

In the papermaking of the paper base, various internal auxiliary agents for papermaking such as various known yield improvers such as an anionic yield rate improver, a nonionic yield rate improver, a cationic yield rate improver or an amphoteric yield rate improver, freeness improvers, paper strengthening agents, and internal sizing agents may be appropriately added to paper stocks including the pulps and the loading material, as necessary. Furthermore, various internal auxiliary agents for papermaking such as dyes, fluorescent whitening agents, pH adjusting agents, defoaming agents, pitch control agents, slime control agents may be appropriately added as necessary.

In addition, a surface smoothness adjustment, strength improvement, and a size adjustment may be improved by coating and impregnating a surface with starches, polyvinyl alcohols or cationic resins. In order to increase the smoothness of the paper base, a smoothing treatment by a calendar may be carried out.

The basis weight of the paper base is preferably 10 to 300 $g/m^2$, and more preferably 50 to 250 $g/m^2$. When the basis weight of the paper base is equal to or more than the lower limit, the rigidity of the paper base is increased, the porous coating layer can be easily provided, and sufficient wet tensile strength can be obtained so that the paper base is not easily fractured and the microfibrous cellulose-containing sheet production stops due to repairs can be reduced. On the other hand, when the basis weight of the paper base is equal to or less than the upper limit, the filtration time can be reduced when the microfibrous cellulose-containing sheet is produced and the productivity of the microfibrous cellulose-containing sheet is increased.

Oken-type air permeability of the paper base (JAPAN TAPPI Paper Pulp Test Method No. 5-2:2000, hereafter, simply referred to as "air permeability" in some cases) is preferably equal to or less than 300 seconds, further preferably equal to or less than 150 seconds, and particularly preferably equal to or less than 75 seconds. When the air permeability is equal to or less than the upper limit, the water permeability of the wire for papermaking is increased, and filtration time can be reduced in the production of the microfibrous cellulose-containing sheet which will be described later.

On the other hand, when the air permeability is less than the lower limit, there is a tendency for microfibrous cellulose to not be easily trapped so that the air permeability is preferably equal to or more than 3 seconds.

The wet tensile strength of the paper base is preferably equal to or more than 0.1 kN/m, and more preferably equal to or more than 0.2 kN/m. Here, the wet tensile strength is a value which is obtained by measuring the paper base in a flow direction (MD direction) according to JIS P 8135.

When the wet tensile strength of the paper base is equal to or more than the lower limit, the wire for papermaking is not easily fractured and the microfibrous cellulose-containing sheet production stops due to repairing operations can be reduced in the production of the microfibrous cellulose-containing sheet which will be described later.

As a method for making the wet tensile strength of the paper base equal to or more than the lower limit, a method for increasing a blending amount thereof using NBKP as a pulp component, and a method for blending both cationic starch and anionic polyacrylamide as a paper strengthening agent can be exemplified.

[Water Resistance Base]

In the specification, the water resistance base is a sheet which has a standard tensile strength of equal to or more than 0.5 kN/m and a wet strength ratio of equal to or more than 50%. Here, the standard tensile strength is a value measured according to JIS P 8113. In addition, the wet strength ratio is a value obtained from an equation of (wet tensile strength/standard tensile strength)×100. The wet tensile strength is a value measured according to JIS P 8135.

When the standard tensile strength is less than 0.5 kN/m or the wet strength ratio is less than 50%, the water resistance is insufficient.

The wet tensile strength of the water resistance base is preferably equal to or more than 0.25 kN/m and more preferably equal to or more than 1.0 kN/m. When the wet tensile strength of the water resistance base is equal to or more than the lower limit, the wire for papermaking is not easily fractured and the microfibrous cellulose-containing sheet production stops due to repairing operations can be reduced in the production of the microfibrous cellulose-containing sheet which will be described later.

In order to set the wet tensile strength of the water resistance base in the above range, metal wires, organic fiber woven fabrics, inorganic fiber woven fabrics, organic fiber non-woven fabrics, and inorganic fiber non-woven fabrics may be used.

There is no limitation to the material of the metal wires which is the water resistance base, and, examples of the material of the metal wires include corrosion resistant metal materials, such as stainless steels, titanium alloys, nickel alloys, and bronze alloys.

There is no limitation to the material of organic fibers configuring the organic fiber woven fabrics and organic fiber non-woven fabrics and, for example, polyesters (polyethylene terephthalate, polybutylene terephthalate, polyethylene naphthalate, and polycyclohexane dimethylene terephthalate and the like), polyamides (nylon 6, nylon 66, and the like), polypropylene, polyethylene, polyvinylidene fluoride, vinylon, and rayon can be exemplified.

There is no limitation to the material of inorganic fibers configuring the inorganic fiber woven fabrics and inorganic fiber non-woven fabrics and an example of the material of inorganic fibers includes glass fiber.

The basis weight of the water resistance base is preferably 10 to 300 g/m$^2$ and more preferably 50 to 250 g/m$^2$. When the basis weight of the water resistance base is equal to or more than the lower limit, the rigidity of the water resistance base is increased, the porous coating layer can be easily provided, and sufficient wet tensile strength can be obtained so that fracture is difficult and the microfibrous cellulose-containing sheet production stops due to repairs can be reduced in the production of the microfibrous cellulose-containing sheet which will be described later. On the other hand, when the basis weight of the water resistance base is equal to or less than the upper limit, flexibility can be sufficiently secured and the wire can be wound regardless of before and after coating of the porous coating layer so that the wire for papermaking is easily produced.

(Porous Coating Layer)

The porous coating layer is a layer which contains a pigment and an adhesive as main components.

When the porous coating layer contains the pigment and the adhesive, an inside gap between the pigments or in a case where the pigment is a porous pigment is a pore. The pigments are bound to each other by the adhesive and retained. In addition, the porous coating layer may be a single layer or multiple layers.

When the porosity of the porous coating layer is equal to or more than 10%, the porous coating layer is available, and the porosity is preferably equal to or more than 25%, and further preferably 40 to 80%.

[Hydrophobizing Agent]

The porous coating layer may contain a hydrophobizing agent.

The hydrophobizing agent is a substance which has a low affinity with water and does not easily dissolve in water and is not easily mixed with water. Specifically, a contact angle of water measured as follows is equal to or more than 90°.

Method for Measuring Contact Angle

The hydrophobizing agent is applied to the surface of polyethylene terephthalate on which a corona treatment was carried out with a coating amount of 1 g/m$^2$ and distilled water is dropped on the coated surface of the hydrophobizing agent to measure the contact angle after 1 minute using a dynamic contact angle goniometer.

Since the hydrophobizing agent can increase the release properties of the microfibrous cellulose from the porous coating layer, the hydrophobizing agent is preferably at least one kind selected from the group consisting of silicone compounds, fluorine compounds, polyolefin waxes, higher fatty acid amides, higher fatty acid alkali salts, and acrylic-based polymers, and more preferably silicone compounds.

Examples of the silicone compounds include silicone oils and silicone waxes.

Examples of the fluorine compounds include polytetrafluoroethylenes.

Examples of the polyolefin waxes include paraffin waxes, carnauba waxes, microcrystalline waxes, polyethylene waxes, polypropylene waxes and polyethylene oxide waxes.

Examples of the higher fatty acid amides include oleic acid amide, erucic acid amide, stearic acid amide, behenic acid amide and ethylene bisstearyl amide.

Examples of the higher fatty acid alkali salts include calcium stearate, zinc stearate, potassium oleate and ammonium oleate.

Examples of the acrylic-based polymers include homopolymers or copolymers of alkyl(meth)acrylic acid ester monomers such as methyl acrylate, n-butyl acrylate, methyl methacrylate, and n-butyl methacrylate and copolymers of the alkyl(meth)acrylic acid ester monomers and other vinyl polymerizable monomers such as styrene and butadiene.

The above compounds may be used singly or in combination of two or more kinds thereof.

The hydrophobizing agent may be evenly contained in the porous coating layer, or may be unevenly distributed to an exposed surface. In terms of being capable of obtaining sufficient peeling properties with a small used amount of the hydrophobizing agent, it is preferable that the hydrophobizing agent be unevenly distributed to the exposed surface of the porous coating layer.

When the hydrophobizing agent is evenly contained in the porous coating layer, the amount of the hydrophobizing agent is preferably 0.01 to 10 parts by mass with respect to the 100 parts by mass of the porous coating layer, and more preferably 0.1 to 5 parts by mass.

When the hydrophobizing agent is unevenly distributed to the exposed surface, the hydrophobizing agent is contained in the porous coating layer by coating and the coating amount thereof is preferably 0.01 to 10 g/m$^2$, and more preferably 0.1 to 5 g/m$^2$, and further preferably 0.2 to 2 g/m$^2$.

When the hydrophobizing agent is evenly contained in the porous coating layer and when the hydrophobizing agent is unevenly distributed to the exposed surface, the release properties of the microfibrous cellulose from the hydrophobizing agent can be sufficiently increased, as long as the amount of the hydrophobizing agent is equal to or more than the lower limit, and the porosity can be sufficiently secured as long as the amount of the hydrophobizing agent is equal to or less than the upper limit.

[Porous Pigment]

When the porous coating layer contains a porous pigment and an adhesive as main components, as for the porous pigment, dry silica, wet silica (for example, precipitation method and gel method), colloidal silica, aluminum oxide, pseudoboehmite, alumina silicate, kaolin, clay, calcined clay, zinc oxide, tin oxide, magnesium sulfate, aluminum hydroxide, calcium carbonate, satin white, aluminum silicate, smectite, zeolite, magnesium silicate, magnesium carbonate, magnesium oxide, diatomaceous earth, styrene plastic pigments, urea resin-based plastic pigments and the like are used. The porous pigments are used singly or in combination of two or more kinds thereof.

Since the dehydration speed of the microfibrous cellulose becomes fast, dry silica, wet silica, aluminum oxide and pseudoboehmite are preferable among the porous pigments.

In addition, the porous pigments may have either primary particles or secondary particles. In the present invention, particles in which the secondary particles are further aggregated are also referred to as secondary particles.

[Adhesive]

When the porous coating layer has a porous pigment and an adhesive as main components, examples of the adhesives include starches such as cationic starch, amphoteric starch, oxidized starch, enzymatically modified starch, thermochemically modified starch, esterified starch, and etherified starch; cellulose derivatives such as carboxy methylcellulose and hydroxy ethylcellulose; natural or semisynthetic high molecular compounds such as gelatin, casein, soybean protein, and natural rubber; polydienes such as polyvinyl alcohols, polyisoprenes, polyneoprenes, and polybutadienes; polyalkenes such as polybutenes, polyisobutylenes, polypropylenes, and polyethylenes; vinyl-based polymers or copolymers such as vinyl halides, vinyl acetates, styrene, (meth) acrylic acids, (meth)acrylic acid esters, (meth)acrylic amides, ethylene acetate vinyl and methylvinyl ethers; synthetic resin-based latexes such as styrene-butadiene based ones, methyl methacrylate-butadiene based ones; and synthetic resins such as polyurethane resins, polyester resins, polyamide resins, olefin-anhydrous maleic acid resins, and melamine resins. The adhesives can be used singly or in combination of two or more kinds thereof.

Among the adhesives, in order to improve the water resistance and coating film strength of the porous coating layer, polyvinyl alcohols and/or synthetic resin-based latexes are preferable. Furthermore, among polyvinyl alcohols, a silanol-modified polyvinyl alcohol and a polyvinyl alcohol having a polymerization degree of equal to or more than 1500 are preferable in terms of coating film strength.

[Ratio of Porous Pigment and Adhesive]

The ratio of porous pigment and the adhesive in the porous coating layer are not particularly limited and it is preferable that the adhesive be 5 to 100 parts by mass with respect to 100 parts by mass of the porous pigment and more preferable to be 10 to 60 parts by mass. Since the ratio of the porous pigment and the adhesive fall in these ranges, the coating film strength and porous balance become favorable.

When the main component is silica as the porous pigment, it is preferable that the adhesive be 10 to 60 parts by mass with respect to 100 parts by mass of the porous pigment.

(Other Components)

The porous coating layer may contain a cationic compound. When the porous coating layer contains a cationic compound, and the microfibrous cellulose is in contact with the porous coating layer during filtration and dehydration in the production of the microfibrous cellulose-containing sheet which will be described later, the microfibrous cellulose of many plants has a negative zeta potential so that aggregation easily occurs, clogging is prevented and the yield rate is prevented from being decreased.

As for the cationic compound, there is no particular limitation, and organic cationic compounds such as cationic resins and inorganic cationic compounds such as polyaluminum chloride, can be used singly or in combination of two or more kinds thereof.

In addition, various auxiliary agents such as a thickener, a defoaming agent, a wetting agent, a colorant, an antistatic agent, the light-proof auxiliary agent, light resistance auxiliary agent, ultraviolet absorber, antioxidant, and antiseptic may be contained in the porous coating layer, as necessary.

(Pore Diameter Distribution Curve)

A pore diameter distribution curve shows the diameter distribution of pores in the porous coating layer and as a result of the inspection of the inventors, it was confirmed that the distribution had an influence on the dehydration speed, the yield rate, and the surface quality of an obtainable microfibrous cellulose-containing sheet.

The peak on the pore diameter distribution curve of the porous coating layer will be described.

For the measurement of the pore diameter distribution curve, the porous coating layer is removed from the base (for example, water resistance base and paper base) to avoid an influence on the base (for example, water resistance base and paper base) and the measurement is performed using the removed porous coating layer in the mercury press-in method. When the porous coating layer has equal to or more than 2 layers, these layers may be mixed when removing. While the porous coating layers of equal to or more than 2 layers are mixed, a desired effect can be obtained as long as the peak of the pore diameter distribution curve is in a predetermined range which will be described later.

In the measurement of pore diameter using the mercury press-in method, the pore diameter is obtained using the following Lucas-Washburn equation based on the assumption that the cross-section of the pore is circular.

$$R=-2\gamma\cos\theta/P$$

In the equation, R is a pore radius (that is, 2R is a pore diameter), $\gamma$ is surface tension of mercury (dyn/cm), $\beta$ is a contact angle (°), and P is pressure (psia). Here, the surface tension of mercury $\gamma$ is set to 482.536 dyn/cm and the contact angle $\beta$ is set to 130°.

In addition, the measurement is performed at a low pressure portion (0 to 30 psia, measured pore diameter: 360 μm to 6 μm) and a high pressure portion (30 to 30000 psia, measured pore diameter: 6 μm to 6 nm) of the mercury pressure.

Figure 2:
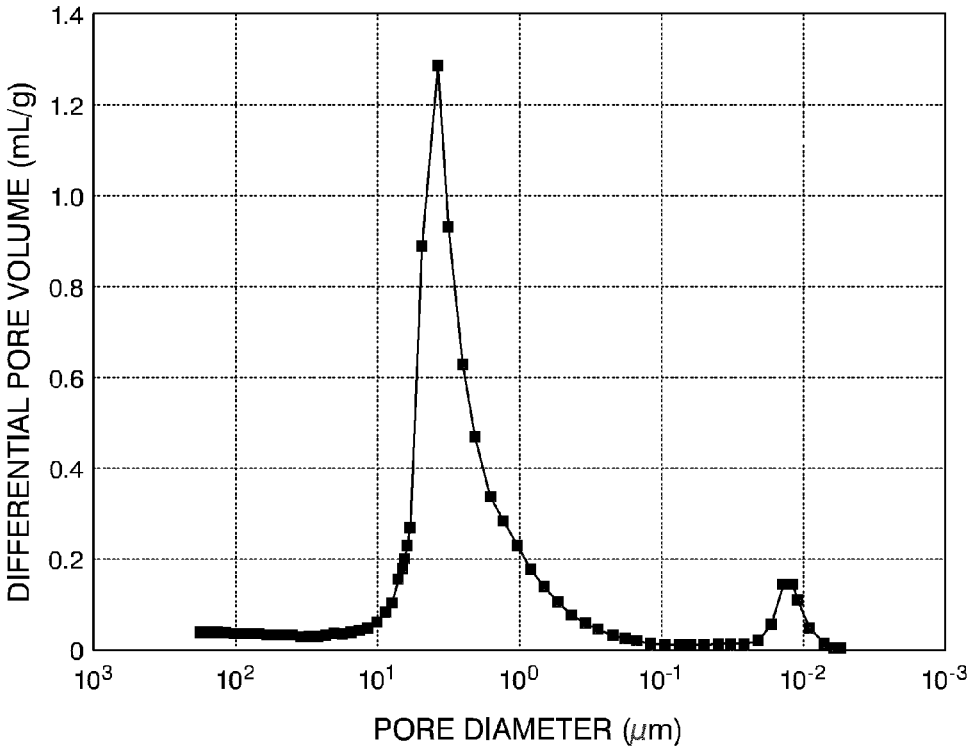
FIG. 2 is a graph showing an example of a pore diameter distribution curve.

The pore diameter distribution curve is obtained using the above Lucas-Washburn equation. Specifically, the pressure which is applied to the mercury is gradually changed and the mercury penetrates into the pore of the porous coating layer. At that time, the pore diameter is obtained one by one, using the above Lucas-Washburn equation, and furthermore, from the pore diameter, the volume of the mercury, that is, pore volume V of the mercury which penetrated into the pore of the porous coating layer is obtained. Then, differential pore volume dV/d (2R) is obtained by plotting the pore diameter 2R and the pore volume V. Furthermore, as shown in the example of FIG. 2, the differential pore volume dV/d (2R) is set as a vertical axis, and the pore diameter 2R is set as a horizontal axis to obtain the pore diameter distribution curve. For example, the pore distribution can be measured by using a micrometrix pore sizer 9320 (produced by Shimadzu Corporation).

When a pigment consisting of secondary particles is contained as a porous pigment, it is preferable that one peak or more respectively be in ranges of pore diameters of equal to or less than 0.1 μm and 0.2 to 20 μm in the pore diameter distribution curve of the porous coating layer. Here, it is assumed that the pore having a diameter of equal to or less than 0.1 μm is a pore (that is, a pore in the secondary particle) based on a gap between the primary particles in the secondary particle and the pore having a diameter of 0.2 to 20 μm is a pore based on a gap between the secondary particles. In the porous coating layer having one peak or more respectively in ranges of pore diameters of equal to or less than 0.1 μm and 0.2 to 20 μm, it can be considered that microfibrous cellulose is trapped by a small pore having a diameter of equal to or less than 0.1 μm, and water permeability can be increased by a large pore having a diameter of 0.2 to 20 μm. Accordingly, the microfibrous cellulose is sufficiently trapped to increase yield rate and clogging is suppressed to increase dehydration speed. In addition, when the porous coating layer has one peak or more respectively in ranges of pore diameters of equal to or less than 0.1 μm and 0.2 to 20 μm pore, the surface quality of an obtainable microfibrous cellulose-containing sheet can be favorable.

When the peak is only in the range of equal to or more than 20 μm, there is concern that the microfibrous cellulose cannot be trapped similar to a general papermaking wire or a metal mesh.

In addition, when a pigment consisting of secondary particles is contained as a porous pigment, it is preferable that a peak substantially be only in the range of the pore diameter of equal to or less than 0.1 μm in the pore diameter distribution curve of the porous coating layer. When a peak is only in the range of a pore diameter of equal to or less than 0.1 μm pore, the trapping properties of the microfibrous cellulose is increased and the yield rate is improved. In addition, since the smoothness of the exposed surface of the porous coating layer is improved, the surface quality of an obtainable microfibrous cellulose-containing sheet can be favorable.

Here, "substantially" means that only a peak based on the diameter of a pore formed by the porous pigment is extracted and a peak is based on the diameter of a hole of a crack generated in drying when the porous coating layer is formed is excluded.

In order to obtain the pore diameter distribution curve, the kind of porous pigment and the selection of average particle diameter are important, and in order to have the pore diameter distribution curve having one peak or more respectively in ranges of pore diameters of equal to or less than 0.1 μm and 0.2 to 20 μm pore, a porous pigment having an average particle diameter of equal to or less than 50 μm may be used.

In addition, in order to have the pore diameter distribution curve having one peak or more respectively in ranges of pore diameters of equal to or less than 0.1 μm and 0.2 to 20 μm, it is preferable for the adhesive to be 5 to 100 parts by mass with respective to 100 parts by mass of the porous pigment.

In order to have the pore diameter distribution curve substantially having a peak only in the range of a pore diameter of equal to or less than 0.1 μm, it is preferable for the porous pigment to have average particle diameter of equal to or less than 0.7 μm.

In addition, in order to have the pore diameter distribution curve substantially having a peak only in the range of a pore diameter of equal to or less than 0.1 μm, it is preferable for the adhesive to be 5 to 30 parts by mass with respective to 100 parts by mass of the porous pigment.

In addition, in order to have the pore diameter distribution curve substantially having a peak only in the range of a pore diameter of equal to or less than 0.1 it is possible to apply a method for gelling a coating material for forming a porous coating layer and drying the gelled coating material after coating.

(Physical Properties of Wire for Papermaking)

Oken-type air permeability of the wire for papermaking (JAPAN TAPPI Paper Pulp Test Method No. 5-2:2000) is preferably equal to or less than 1000 seconds, more preferably equal to or less than 500 seconds and further preferably equal to or less than 200 seconds. When the air permeability of the wire for papermaking is equal to or less than the upper limit, filtration time is reduced and microfibrous cellulose can be effectively formed into a sheet in the production of the microfibrous cellulose-containing sheet which will be described later.

It is preferable for the air permeability of the wire for papermaking to be equal to or more than 5 seconds. There is concern that the pore is large and the microfibrous cellulose cannot be trapped when the air permeability is less than the lower limit.

It is preferable that the wet tensile strength of the wire for papermaking of the present invention (measured according to JIS P 8135, and measured in a flow direction (MD direction) of paper) be equal to or more than 0.1 kN/m, and it is more preferable to be equal to or more than 0.2 kN/m. When the wet tensile strength is equal to or more than the lower limit, fracture does not easily occur in the production of the microfibrous cellulose-containing sheet which will be described later. Since the wet tensile strength of the wire for papermaking depends on the wet tensile strength of the base, a base having a high wet tensile strength may be used to improve the wet tensile strength of the wire for papermaking. Furthermore, the base is a water resistance base and the wet tensile strength (measured according to JIS P 8135) of the wire for papermaking which contains a porous pigment and an adhesive as a porous coating layer is preferably equal to or more than 0.25 kN/m and more preferably equal to or more than 1.0 kN/m from the viewpoint of practical use.

(Method for Producing Wire for Papermaking)

The wire for papermaking which contains a water resistance base or a paper base and a porous pigment and an adhesive as a porous coating layer is produced by coating at least one surface of the water resistance base or the paper base with the coating material for forming a porous coating layer and drying the coated surface.

When the porous coating layer contains a porous pigment and an adhesive, the coating material for forming a porous coating layer contains the porous pigment and the adhesive as a dispersion medium. The dispersion medium may be any kind of water, an organic solvent, or a mixture of water and an organic solvent.

A method for producing a wire for papermaking porous containing a porous pigment, an adhesive and a hydrophobizing agent as a coating layer is different in a case in which the hydrophobizing agent is evenly contained in the porous coating layer, and in a case in which the hydrophobizing agent is unevenly distributed to the exposed surface of the porous coating layer.

In the production of the wire for papermaking in the case in which the hydrophobizing agent is evenly contained in the porous coating layer, for example, the coating material for forming a porous coating layer containing the hydrophobizing agent and dispersion medium is applied to at least one surface of the base, and dried. The dispersion medium may be any kind of water, an organic solvent or a mixture of water and an organic solvent.

Examples of coaters which perform coating with a coating material for forming a porous coating layer include a blade coater, air knife coater, roll coater, bar coater, gravure coater, rod blade coater, lip coater, curtain coater and die coater.

A dry coating amount of the coating material for forming a porous coating layer is preferably 1 to 60 g/m$^2$, more preferably 2 to 45 g/m$^2$, and further preferably 3 to 30 g/m$^2$. When the dry coating amount of the coating material for forming a porous coating layer is equal to or more than the lower limit, the microfibrous cellulose can be easily trapped and the obtained microfibrous cellulose-containing sheet can be easily peeled off. On the other hand, when the dry coating amount of the coating material for forming a porous coating layer is equal to or less than the upper limit, the porous coating layer is easily formed and the flexibility of the wire for papermaking can be sufficiently secured.

As for drying, heated-air drying using normal heated air, heated-air drying by infrared radiation and vacuum drying can be applied.

After applying the coating material for forming a porous coating layer, a finishing treatment may be performed using calendars such as a machine calendar, a super calendar or a soft calendar. When the finishing treatment is performed, the smoothness of the exposed surface of the porous coating layer is improved, and the surface quality of the microfibrous cellulose-containing sheet obtained using the wire for papermaking is improved.

As for the wire for papermaking containing a porous pigment, an adhesive and a hydrophobizing agent as the porous coating layer, for example, after the coating material for forming a porous coating layer is applied to at least one surface of the base, and dried to form a porous coating layer not containing the hydrophobizing agent in the production of the wire for papermaking in which the hydrophobizing agent is unevenly distributed to the exposed surface of the porous coating layer, a hydrophobizing agent coating material containing the hydrophobizing agent is applied to an exposed surface of the porous coating layer not containing the hydrophobizing agent. A coater of the hydrophobizing agent coating material can be used as the same apparatus as the coater of the coating material for forming a porous coating layer.

(Effects)

In addition, the porous coating layer functions as a filtration film in the wire for papermaking of the present invention and the microfibrous cellulose can be sufficiently trapped in the filtration film of the porous coating layer when the microfibrous cellulose suspension is filtered so that the yield rate can be increased. However, clogging does not easily occur, the filtration speed can be fast and the productivity is high.

In addition, the surface smoothness of the porous coating layer is higher than the surface smoothness of a general wire and the microfibrous cellulose-containing sheet having favorable surface quality can be obtained. When the porous coating layer contains the hydrophobizing agent, peeling properties are increased and productivity is improved.

In addition, since the wire for papermaking of the present invention is configured to include at least the base and the porous coating layer, mass production can be easily performed at a low cost.

Moreover, while the wire for papermaking including the water resistance base has an excellent water resistance, the microfibrous cellulose suspension is supplied and water is contained, damage, wrinkles and extension are suppressed from occurring so that the wire can be repeatedly used.

Furthermore, since the wire for papermaking including the paper base is configured to include at least the paper base and the porous coating layer, mass production can be easily performed at a low cost and when the wire is used and becomes unnecessary in the papermaking of the microfibrous cellulose due to clogging, it is possible to be recycled as general paper.

<Microfibrous Cellulose-Containing Sheet>

The microfibrous cellulose-containing sheet which can be obtained using the method for producing a microfibrous cellulose-containing sheet of the present invention is a sheet in which the microfibrous cellulose is made into paper.

Here, the microfibrous cellulose is an aggregation of cellulose molecules having a width (diameter) of 2 nm to 1000 nm measured by the observation of a scanning or transmission electron microscope. Such microfibrous cellulose is fiber or rodlike particles which have a considerably smaller width than that of pulp fiber usually used for papermaking. When the width of fibrous cellulose is less than 2 nm, the cellulose dissolves in water as a cellulose molecule so that physical properties (strength or rigidity, dimensional stability) as microfiber are not expressed. On the other hand, when the width exceeds 1000 nm, the fiber cannot be said to be microfiber and contains normal pulp so that microfiber physical properties (strength or rigidity, dimensional stability) as microfiber cannot be obtained.

As a method for obtaining microfibrous cellulose, for example, there may be a method for micronizing cellulose-based fiber with the wet crushing using a mechanical operation of a grinder (ultra-fine friction grinder), a high pressure homogenizer or ultrahigh pressure homogenizer, a high pressure impact-type grinder, a disc-type refiner, and a conical refiner.

In addition, the cellulose-based fiber may be micronized after chemical treatments such as 2,2,6,6-tetramethylpiperidine 1-oxyl (TEMPO) oxidation, an enzyme treatment or an ozone treatment are carried out.

Examples of the cellulose-based fibers to be micronized include cellulose derived from plants, cellulose derived from animals and cellulose derived from bacteria. More specifically, examples of the cellulose-based fibers include pulps for making tree-based paper such as softwood pulp or hardwood pulp; cotton-based pulp such as cotton linter or cotton lint; non-tree-based pulp, such as linen, wheat straw, or bagasse; cellulose isolated from sea squirt, marine plants, or the like. Among the examples, pulp for making tree-based paper or non-tree-based pulp is preferred in terms of ease of procurement.

Sizing agents, paper strengthening agents, loading material and the like may be added to the microfibrous cellulose-containing sheet similar to general paper, as necessary.

<Method for Producing Microfibrous Cellulose-Containing Sheet>

An embodiment of the method for producing a microfibrous cellulose-containing sheet of the present invention will be described.

The method for producing a microfibrous cellulose-containing sheet of the embodiment includes the steps of filtering and dehydrating a microfibrous cellulose suspension using the wire for papermaking to obtain a hydrous web and drying the hydrous web.

(Producing Apparatus)

Figure 3:
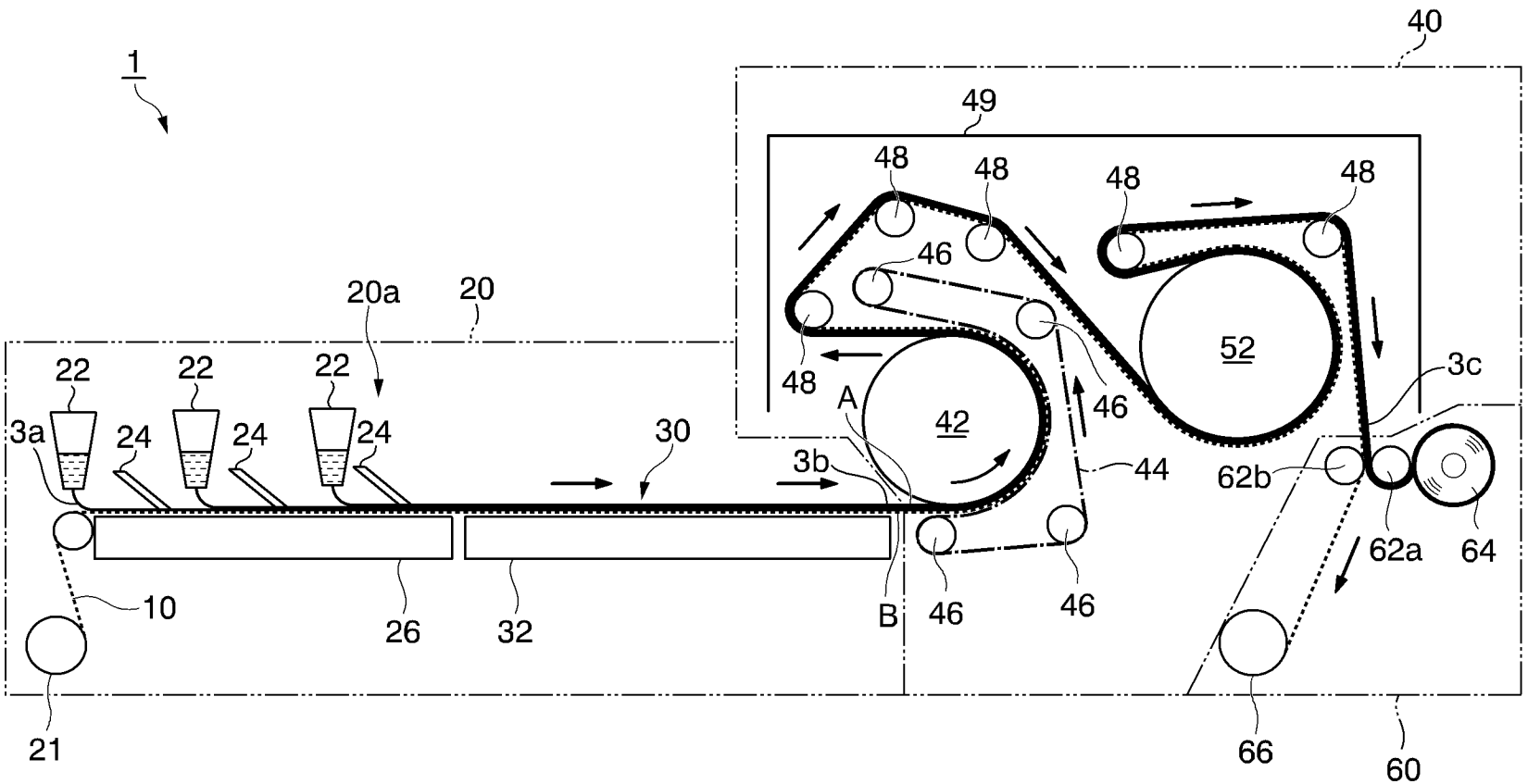
FIG. 3 is a schematic configuration view of an embodiment of a producing apparatus used in a method for producing a microfibrous cellulose-containing sheet of the present invention.

For example, as shown in FIG. 3, as an apparatus to produce a microfibrous cellulose-containing sheet, a producing apparatus 1 which includes a dewatering section 20, a drying section 40 provided on a downstream side of the dewatering section 20 and a winding section 60 provided on a downstream side of the drying section can be used.

The dewatering section 20 is a section which dewaters a microfibrous cellulose suspension 3*a* using a wire for papermaking 10 to obtain a hydrous web 3*b*.

In the dewatering section 20, a sending reel 21 which sends the wire for papermaking 10, a discharging portion 20*a* of the microfibrous cellulose suspension 3*a*, and a dewatering portion 30 of a dispersion medium are provided.

In the discharging portion 20*a*, plural die heads 22 which discharge the microfibrous cellulose suspension 3*a* to the upper surface of the wire for papermaking 10 sent from the sending reel 21 in a travelling state, and a plate 24 which makes the upper surface of the microfibrous cellulose suspension 3*a* disposed on a downstream side of each of the die heads 22 and discharged even are provided.

In the discharging portion 20*a* and the dewatering portion 30, aspirators 26 and 32 in which the dispersion medium is forced to be dewatered from the microfibrous cellulose suspension 3*a* are provided. The aspirators 26 and 32 are disposed below the wire for papermaking 10 and a large number of vacuum ports (not shown) connected to a vacuum pump (not shown) are formed on the upper surface thereof. However, the vacuum ports are not formed on an upstream side of the aspirator 26, and are preferably set as non-vacuum ports which are not connected to the vacuum pump. When the vacuum ports are formed on the upstream side, there is concern that the coating film surface of the microfibrous cellulose suspension 3*a* is coarse. In addition, since a dewatering amount is small on the downstream side, the aspirator 32 may not have ports formed on the downstream side in the dewatering portion 30.

The drying section 40 is a section which dries the hydrous web 3*b* using a dryer to obtain a microfibrous cellulose-containing sheet 3*c*.

In the drying section 40, a first dryer 42 and a second dryer 52 configured by a cylinder dryer and a felt cloth 44 disposed along the outer circumference of the first dryer 42 are provided in a hood 49. The first dryer 42 is disposed on the upstream side from the second dryer 52. In addition, the felt cloth 44 is formed in an endless shape and travels by guide rolls 46 in a circulation manner.

In the drying section 40, the hydrous web 3*b* is transported by guide rolls 48. Specifically, first, the hydrous web 3*b* is transported so that a surface A to which the microfibrous cellulose suspension 3*a* of the hydrous web 3*b* is applied (hereafter, referred to as "coated surface A") is in contact with an outer circumferential surface of the first dryer 42 and a surface B to which the microfibrous cellulose suspension 3*a* of the hydrous web 3*b* is not applied (hereafter, referred to as "non-coated surface B") is in contact with the felt cloth 44, and then, the coated surface A is in contact with an outer circumferential surface of the second dryer 52.

The winding section 60 is a section which separates the microfibrous cellulose-containing sheet 3*c* from the wire for papermaking 10 and winds the microfibrous cellulose-containing sheet.

In the winding section 60, a pair of separation rollers 62*a* and 62*b* which separate the microfibrous cellulose-containing sheet 3*c* from the wire for papermaking 10, a winding reel 64 which winds the microfibrous cellulose-containing sheet 3*c*, and a collecting reel 66 which collects the used wire for papermaking 10 are provided. The separation roller 62*b* is disposed on the wire for papermaking 10 side and the separation roller 62*a* is disposed on the microfibrous cellulose-containing sheet 3*c* side.

(Dewatering Step)

In a dewatering step, the wire for papermaking 10 is sent from the sending reel 21, the microfibrous cellulose suspension 3*a* is discharged the upper surface of the wire for papermaking 10 from die heads 22, and the upper surface of the microfibrous cellulose suspension 3*a* of the wire for papermaking 10 becomes even by the plate 24. Along with the above operation, the aspirators 26 and 32 suction and dewater the dispersion medium contained the microfibrous cellulose suspension 3*a* on the wire for papermaking 10 to obtain the hydrous web 3*b*.

In the dewatering step, when the travelling tension of the wire for papermaking 10 is large, there is concern that the wire for papermaking 10 is fractured so that a wire used in the usual papermaking may be disposed below the wire for papermaking 10 to support the wire for papermaking 10.

When the paperbase is used as a base, before the microfibrous cellulose suspension 3*a* is supplied to the wire for papermaking 10, the wire for papermaking 10 may be impregnated with water to be in a wet state in advance.

When the microfibrous cellulose suspension 3*a* is discharged to the wire for papermaking 10, the wire extends due to water absorption of the paper base to generate wrinkles, and when the wire is in a wet state in advance, the wrinkle generation can be prevented.

Examples of means for the wire for papermaking 10 being in a wet state include a water tank to dip the wire for papermaking 10 into water and a water coater. As the water coater, a blade coater, an air knife coater, a roll coater, a bar coater, a gravure coater, a rod blade coater, a lip coater, a curtain coater and a die coater.

In the dewatering step, the microfibrous cellulose suspension 3*a* supplied to the wire for papermaking 10 is a liquid which contains microfibrous cellulose and water.

In order to improve the porosity of the obtained microfibrous cellulose-containing sheet 3*c*, it is preferable that an organic solvent be contained in the microfibrous cellulose suspension 3*a*. When the organic solvents are mixed, the mass ratio of water and the organic solvent (water:organic solvent) is preferably 100:10 to 10:100, more preferably 100:30 to 30:100, and further preferably 100:50 to 50:100.

When the mixed amount of the organic solvent is equal to or more than the lower limit, the porosity of the microfibrous cellulose-containing sheet 3*c* can be sufficiently improved, and when the mixed amount of the organic solvent is equal to or less than the upper limit, the microfibrous cellulose suspension 3*a* can be suppressed from having a high viscosity.

In addition, the microfibrous cellulose suspension 3*a* may contain a resin emulsion. Here, the resin emulsion is an emulsion in which particles of a natural resin or a synthetic resin having a particle diameter of 0.001 to 10 μm are emulsified in water.

The particulate resin included in the resin emulsion is not particularly limited, and examples of the resins include resin emulsions such as polystyrene, polyvinyl chloride, polyvinylidene chloride, polyvinyl acetate, ethylene-vinyl acetate copolymers, alkyl poly(meth)acrylate ester copolymers, alkyl(meth)acrylate ester copolymers, poly(meth)acrylonitrile, polyesters, and polyurethanes, natural rubber, styrene-butadiene copolymers, styrene-butadiene copolymers in which the molecular chain terminal is modified with at least one functional group selected from the group of —SH, —CSSH, —$SO_3H$, —$(COO)_xM$, —$(SO_3)_xM$, and —CO—R (meanwhile, in the functional groups, M represents a cation, x represents an integer of 1 to 3, which is dependent on the valence of M, and R is an alkyl group), acid-, amine-, amide-, acryl-, and other-modified styrene-butadiene copolymers, (meth)acrylonitrile-butadiene copolymers, polyisoprene, polychloroprene, styrene-butadiene-methyl methacrylate copolymers, styrene-alkyl(meth)acrylate ester copolymers, and the like.

In addition, polyethylene, polypropylene, polyurethane, and ethylene-vinyl acetate copolymers, and the like may be emulsified by post emulsification to be used.

Examples of the organic solvents include glycol ethers such as dipropylene glycol methyl ether, ethylene glycol monobutyl ether and diethylene glycol monoethyl ether; glymes such as diethylene glycol dimethyl ether, diethylene glycol dibutyl ether, tetraethylene glycol dimethyl ether, triethylene glycol dimethyl ether, diethylene glycol diethyl ether, ethylene glycol diethyl ether, ethylene glycol dimethyl ether and diethylene glycol isopropyl methyl ether; divalent alcohols such as 1,2-butanediol, and 1,6-hexanediol, diethylene glycol monoethyl ether acetate, and ethylene glycol monoethyl ether acetate. The organic solvents may be used singly or in combination of two or more kinds thereof.

The solid content concentration of the microfibrous cellulose suspension 3*a* is preferably 0.05 to 1.5% by mass, and more preferably 0.1 to 0.8% by mass. When the concentration of the microfibrous cellulose suspension 3*a* is equal to or more than the lower limit, sufficient production efficiency can be secured in the dewatering step, and when the concentration of the microfibrous cellulose suspension is equal to or less than the upper limit, the microfibrous cellulose suspension can be suppressed from having a high viscosity and handling properties can be improved.

In the dewatering step, the microfibrous cellulose suspension 3*a* is supplied so that the basis weight of the obtainable microfibrous cellulose-containing sheet 3*c* is preferably 1 to 1000 g/m$^2$, more preferably 2 to 500 g/m$^2$, and further preferably 5 to 100 g/m$^2$. When the basis weight is equal to or more than the lower limit, the obtained microfibrous cellulose-containing sheet 3*c* can be easily peeled off from the wire for papermaking 10 and be suitable for continuous production. On the other hand, when the basis weight is equal to or less than the upper limit, the dehydration time can be reduced and the productivity can be improved.

(Drying Step)

In a drying step, first, the hydrous web 3*b* mounted on the upper surface of the wire for papermaking 10 is looped approximately half around the outer circumferential surface of the heated first dryer 42 so that the coated surface A is in contact with the outer circumferential surface of the first dryer 42, and the dispersion medium remaining in the hydrous web 3*b* is evaporated. The evaporated dispersion medium passes through the pores of the wire for papermaking 10 and evaporated from the felt cloth 44.

Next, the hydrous web 3*b* is wound approximately three-quarters around the outer circumferential surface of the heated second dryer 52 so that the coated surface A is in contact with the outer circumferential surface of the second dryer 52, and the dispersion medium remained in the hydrous web 3*b* is evaporated.

In this manner, the hydrous web 3*b* is dried to obtain the microfibrous cellulose-containing sheet 3*c*.

(Winding Step)

In a winding step, by pinching the wire for papermaking 10 and the microfibrous cellulose-containing sheet 3*c* between the pair of separation rollers 62*a* and 62*b*, the microfibrous cellulose-containing sheet 3*c* is separated from the wire for papermaking 10 and transferred to the surface of one separation roller 62*a*. Then, the microfibrous cellulose-containing sheet 3*c* is pulled and separated from the surface of the separation roller 62*a* and is wound by the winding reel 64. Along with the operation, the used wire for papermaking 10 is wound by the collecting reel 66.

As described above, the microfibrous cellulose-containing sheet can be obtained by using the wire for papermaking 10.

(Effects)

Since the microfibrous cellulose suspension 3*a* is filtered and dehydrated using the wire for papermaking 10 in the method for producing a microfibrous cellulose-containing sheet, the microfibrous cellulose can be sufficiently trapped and the yield rate is increased. Moreover, since clogging does not easily occur and filtration speed is fast, the microfibrous cellulose-containing sheet 3*c* can be produced with high productivity at a low cost.

Furthermore, the exposed surface of the porous coating layer of the wire for papermaking 10 has high evenness and the obtained microfibrous cellulose-containing sheet 3*c* can be easily peeled off from the wire for papermaking 10. For this reason, the surface quality of the obtained microfibrous cellulose-containing sheet 3*c* is favorable.

Moreover, when the porous pigment, adhesive and hydrophobizing agent are contained as the porous coating layer, the exposed surface of the porous coating layer of the wire for papermaking 10 has high evenness and the hydrophobizing agent is contained in the porous coating layer to increase peeling properties so that the obtained microfibrous cellulose-containing sheet 3*c* can be easily peeled off from the wire for papermaking 10.

In particular, even when the microfibrous cellulose-containing sheet 3*c* is continuously produced using the producing apparatus 1 at high speed, the microfibrous cellulose-containing sheet 3*c* can be easily peeled off from the wire for papermaking 10 so that the microfibrous cellulose-containing sheet 3*c* having favorable surface quality can be obtained. In addition, even when the microfibrous cellulose suspension 3*a* contains the resin emulsion which has high adhesive properties, the microfibrous cellulose-containing sheet 3*c* can be easily peeled off from the wire for papermaking 10.

Another Embodiment

As long as the method for producing a microfibrous cellulose-containing sheet of the present invention includes the steps of filtering and dehydrating a microfibrous cellulose suspension using the wire for papermaking of a microfibrous cellulose-containing sheet of the present invention to obtain a hydrous web, and drying the hydrous web, the method for producing a microfibrous cellulose-containing sheet using the producing apparatus 1 may not be used, and for example, a paper machine used when general paper is produced can be easily applied. As for the paper machine, continuous paper machines such as a Fourdrinier paper machine, a cylinder paper machine, a twin-wire paper machine and an inclined paper machine, and a multilayer combination paper machine which is a combination thereof can be applied.

In addition, as long as the production of the microfibrous cellulose-containing sheet includes the steps of filtering and dehydrating a microfibrous cellulose suspension using the wire for papermaking of a microfibrous cellulose-containing sheet of the present invention to obtain a hydrous web, and drying the hydrous web, the microfibrous cellulose-containing sheet may be made by hand.

EXAMPLES

Hereinafter, the present invention will be described in more detail with reference to examples and comparative examples, but the present invention is not limited thereto. In addition, the "parts" and "%" in the examples refer to "parts by mass" and "% by mass" respectively unless otherwise described.

<Production of Wire for Papermaking>

(Base A1)

A paper stock containing 100 parts of LBKP with 450 ml CSF, 10 parts of light calcium carbonate (loading material), 0.05 parts of a sizing agent (trade name: FIVERUN 81K, manufactured by Nihon NSC CO., LTD.), 0.45 parts of aluminum sulfate, 0.5 parts of cationic starch, and 0.4 parts of a polyamide-epichlorohydrin-based paper strengthening agent (trade name: AF-255, manufactured by Arakawa Chemical Industries) was prepared.

After the paper stock was made into paper using the Fourdrinier paper machine and dried, the paper was subjected to a calendar treatment (linear pressure: 100 kgf/cm) to obtain a base A1 with paper moisture of 5.5% and basis weight of 157 g/m$^2$.

(Base C2)

15 parts of NBKP with 550 ml CSF, 85 parts of LBKP with 450 ml CSF, 0.4 parts of a sizing agent (trade name: PEROSER E 3655, manufactured by TOHO Chemical Industry Co., Ltd.), 1.3 parts of aluminum sulfate, 0.35 parts of cationic starch, and 0.2 parts of anionic polyacrylamide (trade name: POLYSTORON 117, manufactured by Arakawa Chemical Industries) were added, to prepare a paper stock.

After the paper stock was made into paper using the Fourdrinier paper machine, oxidized starch (trade name: GRS-T110, manufactured by Oji Cornstarch Co., Ltd.) was applied to both surfaces thereof by an on-machine size press so as to be a coating amount of 0.5 g/m$^2$ and dried. Then, the paper was subjected to a calendar treatment (linear pressure: 150 kg/cm) to obtain a base C2 with paper moisture of 6.0%, and basis weight of 186 g/m$^2$.

(Coating Material for Forming Porous Coating Layer A1)

100 parts of wet type silica (trade name: CARPLEX BS-308N, manufactured by DSL. Japan Co., Ltd) having an average particle diameter of 11 μm, and 30 parts of silanol-modified polyvinyl alcohol (trade name: PVA R-1130, manufactured by Kuraray Co., Ltd.) as an adhesive were mixed, silica was dispersed in an aqueous adhesive solution and adjusted to have a concentration of 15%, thereby obtaining a coating material for forming a porous coating layer A1.

(Coating Material for Forming Porous Coating Layer A2)

In the coating material for forming a porous coating layer A1, with respect to 100 parts of solid content of the coating material for forming a porous coating layer 1, a higher fatty acid amide water resistant additive (trade name: NEUTRON, manufactured by Nippon Fine Chemical Co., Ltd.) was added at a ratio of 1 part of solid content and stirred to be even, thereby obtaining a coating material for forming a porous coating layer A2 having a concentration of 14%.

(Coating Material for Forming Porous Coating Layer A3)

In the coating material for forming a porous coating layer A1, with respect to 100 parts of solid content of the coating material for forming a porous coating layer A1, a olefin-based wax (trade name: S-368NT5, manufactured by Shamrock Technologies, Inc.) was added at a ratio of 1 part of solid content and stirred to be even, thereby obtaining a coating material for forming a porous coating layer A3 having a concentration of 14%.

(Coating Material for Forming Porous Coating Layer A4)

In the coating material for forming a porous coating layer A1, with respect to 100 parts of solid content of the coating material for forming a porous coating layer A1, calcium stearate (manufactured by KAWAMURA KASEI INDUSTRY CO., LTD.) was added at a ratio of 1 part of solid content and stirred to be even, thereby obtaining a coating material for forming a porous coating layer A4 having a concentration of 14%.

(Coating Material for Forming Porous Coating Layer A5)

In the coating material for forming a porous coating layer A1, with respect to 100 parts of solid content of the coating material for forming a porous coating layer A1, a fluorine-based water resistant additive (trade name: AG-E060, manufactured by ASAHI GLASS CO., LTD.) was added at a ratio of 1 part of solid content and stirred to be even, thereby obtaining a coating material for forming a porous coating layer A5 having a concentration of 14%.

(Coating Material for Forming Porous Coating Layer A6)

After an aqueous cationic resin solution of poly diallyldimethylammonium chloride (trade name: UNISENCE CP-103, manufactured by SENKA corporation, 15 parts of solid content) was stirred, wet silica (trade name: CARPLEX BS-308N, manufactured by DSL. Japan Co., Ltd, 100 parts of solid content) having an average particle diameter of 11 μm was added and dispersed. A 10% solution of silanol-modified polyvinyl alcohol (trade name: PVA R-1130, manufactured by Kuraray Co., Ltd., 30 parts of solid content) was added to thus obtained dispersion liquid, and adjusted to have a concentration of 18%, thereby obtaining a coating material for forming a porous coating layer A6.

(Coating Material for Forming Porous Coating Layer A7)

After 100 parts of dry silica (trade name: A200, manufactured by Nippon Aerosil Co., Ltd.) having an average primary particle diameter of about 12 nm, and 10 parts of a diallyldimethylammonium chloride-based cationic resin (DC-902P, manufactured by Dai-ichi Kogyo Seiyaku Co., Ltd.) were prepared and stirred by a homomixer, dry silica was gradually added to a aqueous cationic resin solution to obtain 18% dispersion liquid. A treatment was carried out on the dispersion liquid twice by a high pressure impact-type disperser (ULTIMIZER, manufactured by Sugino Machine Limited) with a pressure of 50 MPa. 3.5 parts of boric acid was added to the dispersion liquid with respect to 100 parts of silica and dissolved. 18 parts of polyvinyl alcohol (trade name: PVA235, manufactured by Kuraray Co., Ltd.) was added to 100 parts of thus obtained dispersion liquid (solid content conversion) as an adhesive to obtain a coating material for forming a porous coating layer A7 having a concentration of 12%.

(Hydrophobizing Coating Material A1)

100 parts of a hydrophobizing agent Peeloil HT consisted of acrylic-based polymers (manufactured by Ipposha Oil Industries Co., Ltd.) was added to a 3:1 mixed solvent of toluene and ethyl acetate to have a concentration of 1%, and stirred to obtain a hydrophobizing coating material A1.

(Hydrophobizing Coating Material A2)

100 parts of a silicone-based hydrophobizing agent (KS 3600, manufactured by Shin-Etsu Chemical Co., Ltd.) and 1 part of a curing agent (trade name: PL50T, manufactured by Shin-Etsu Chemical Co., Ltd.) were added to a 3:1 mixed solvent of toluene and ethyl acetate to have concentration of 1%, and stirred to obtain a hydrophobizing coating material A2.

(Coating Material for Forming Porous Coating Layer C1)

80 parts of heavy calcium carbonate (trade name: SOFTON 1200, manufactured by Shiraishi Calcium Kaisha, Ltd.), 20 parts of calcined kaolin (trade name: SATINTONE PLUS, manufactured by Hayashi-kasei Co., Ltd.), 10 parts of an adhesive (trade name: PA-8064, manufactured by NIPPON A & L INC.), and 6 parts of oxidized starch (trade name: GRS-T110, manufactured by Oji Cornstarch Co., Ltd.) were mixed and adjusted to have a concentration of 40% to obtain a coating material C1.

(Coating Material for Forming Porous Coating Layer C2)

100 parts of calcined kaolin (trade name: SATINTONE PLUS, manufactured by Hayashi-kasei Co., Ltd.), 12 parts of an adhesive (trade name: PA-8064, manufactured by NIPPON A&L INC.), and 6 parts of oxidized starch (trade name: GRS-T110, manufactured by Oji Cornstarch Co., Ltd.) were mixed and adjusted to have a concentration of 40%, to obtain a coating material C2.

(Coating Material for Forming Porous Coating Layer C4)

A coating material C4 was obtained in the same manner as the coating material for forming a porous coating layer A1 except that silica was changed to gel-method silica (trade name: P-412, manufactured by Grace-Davison) having an average particle diameter 7.5 μm.

(Coating Material for Forming Porous Coating Layer C5)

A coating material C5 was obtained in the same manner as the coating material for forming a porous coating layer A1 except that silica was changed to gel-method silica (trade name: MIZUKASIL P-78A, manufactured MIZUSAWA INDUSTRIAL CHEMICALS, LTD.) having an average particle diameter 3.0 μm.

Example A1

The coating material for forming the porous coating layer A2 was applied to one surface of the base A1 by the bar coater to have a coating amount of 10 g/m$^2$, thereby obtaining a wire for papermaking.

Example A2

A wire for papermaking was obtained in the same manner as in Example A1 except that the coating material for forming a porous coating layer A2 was changed to the coating material for forming a porous coating layer A3.

Example A3

A wire for papermaking was obtained in the same manner as in Example A1 except that the coating material for forming a porous coating layer A2 was changed to the coating material for forming a porous coating layer A4.

Example A4

A wire for papermaking was obtained in the same manner as in Example A1 except that the coating material for forming a porous coating layer A2 was changed to the coating material for forming a porous coating layer A5.

Example A5

After the coating material for forming a porous coating layer A1 was applied to the base A1 by the bar coater to have a drying coating amount of 10 g/m$^2$ and dried, the base was subjected to a calendar treatment (30 kgf/cm) to form a porous coating layer. The hydrophobizing coating material A1 was finally applied to the surface of the porous coating layer by the gravure roll coater to have a coating amount of 1 g/m$^2$, thereby obtaining a wire for papermaking.

Example A6

A wire for papermaking was obtained in the same manner as in Example A5 except that the hydrophobizing coating material A1 was changed to the hydrophobizing coating material A2.

Example A7

After the coating material for forming a porous coating layer A6 was applied to the base A1 by the bar coater to have a drying coating amount of 10 g/m$^2$ and dried, the base was subjected to a calendar treatment (30 kgf/cm) to form a porous coating layer. The hydrophobizing coating material A2 was finally applied to the surface of the porous coating layer by the gravure roll coater to have a coating amount of 1 g/m$^2$, thereby obtaining a wire for papermaking.

Example A8

1.0% borax water was applied to the surface of the base A1 to have a coating amount of 10 g/m$^2$ and dried (solid content coating amount of 0.1 g/m$^2$). After the coating material for forming a porous coating layer A7 was applied to the surface of the base to which the borax water had been applied by the die coater to have a drying coating amount of 7 g/m$^2$, and dried, the base was subjected to a calendar treatment (30 kg/cm) to form a porous coating layer. The hydrophobizing coating material A2 was finally applied to the surface of the porous coating layer by the gravure roll coater to have a coating amount of 1 g/m$^2$, thereby obtaining a wire for papermaking.

Example B1

After the coating material for forming a porous coating layer A1 was applied to a commercially available polyethylene mesh (aperture of 122 μm) by the bar coater to have a drying coating amount of 10 g/m$^2$ and dried, a calendar treatment (30 kgf/cm) was carried out to obtain a wire for papermaking of a microfibrous cellulose-containing sheet.

Example B2

After the coating material for forming a porous coating layer A1 was applied to a polypropylene non-woven fabric (STRATECH PP RN2020, manufactured by Idemitsu Kosan Co., Ltd.) by the bar coater to have a drying coating amount of 10 g/m$^2$ and dried, a calendar treatment (30 kgf/cm) was carried out to obtain a wire for papermaking of a microfibrous cellulose-containing sheet.

Example B3

After the coating material for forming a porous coating layer A1 was applied to a commercially available stainless (SUS 304) mesh by the bar coater to have a drying coating amount of 10 g/m$^2$ and dried, a calendar treatment (30 kgf/cm) was carried out to obtain a wire for papermaking of a microfibrous cellulose-containing sheet.

Example B4

After the coating material for forming a porous coating layer A7 of 35° C. was applied to a surface of a polypropylene non-woven fabric (STRATECH PP RN2020, manufactured by Idemitsu Kosan Co., Ltd.) to have a drying coating amount of 10 g/m$^2$, cooled to 3° C., and dried at 40° C. Then, a calendar treatment (30 kg/cm) was carried out to obtain a wire for papermaking of a microfibrous cellulose-containing sheet.

Example C1

After the coating material C1 was applied to the base A1 by the blade coater to have a drying coating amount of 10 g/m$^2$ and dried, a calendar treatment (30 kgf/cm) was carried out to obtain a wire for papermaking of a microfibrous cellulose-containing sheet.

Example C2

After the coating material C2 was applied to the base A1 by the blade coater to have a drying coating amount of 10 g/m$^2$ and dried, a calendar treatment (30 kgf/cm) was carried out to obtain a wire for papermaking of a microfibrous cellulose-containing sheet.

Example C3

After the coating material for forming a porous coating layer A1 was applied to the base A1 by the bar coater to have a drying coating amount of 10 g/m$^2$ and dried, a calendar treatment (30 kgf/cm) was carried out to obtain a wire for papermaking of a microfibrous cellulose-containing sheet.

Example C4

After the coating material C4 was applied to the base A1 by the bar coater to have a drying coating amount of 10 g/m$^2$ and dried, a calendar treatment (30 kgf/cm) was carried out to obtain a wire for papermaking of a microfibrous cellulose-containing sheet.

Example C5

After the coating material C5 was applied to the base A1 by the bar coater to have a drying coating amount of 10 g/m$^2$ and dried, a calendar treatment (30 kgf/cm) was carried out to obtain a wire for papermaking of a microfibrous cellulose-containing sheet.

Example C6

After the coating material for forming a porous coating layer A6 was applied to the base A1 by the bar coater to have a drying coating amount of 10 g/m$^2$ and dried, a calendar treatment (30 kgf/cm) was carried out to obtain a wire for papermaking of a microfibrous cellulose-containing sheet.

Example C7

1.0% borax water was applied to the surface of the base A1 to have a coating amount of 10 g/m$^2$ and dried (solid content coating amount of 0.1 g/m$^2$). After the coating material for forming a porous coating layer A7 was applied to the surface of the base to which the borax water had been applied by the die coater to have a drying coating amount of 7 g/m$^2$, and dried, the base was subjected to a calendar treatment (30 kg/cm) to obtain a wire for papermaking of a microfibrous cellulose-containing sheet.

Example C8

A wire for papermaking of a microfibrous cellulose-containing sheet was obtained in the same manner as in Example C3 except that the base A1 was changed to the paper base C2.

Example C9

After the coating material C5 was applied to the base A1 by the bar coater to have a drying coating amount of 5 g/m$^2$ and dried, the coating material C4 was further applied to the coating film of the coating material C5 by the bar coater to have a drying coating amount of 10 g/m$^2$ and dried, and a calendar treatment (30 kgf/cm) was carried out to obtain a wire for papermaking of a microfibrous cellulose-containing sheet.

Example C10

After the coating material for forming a porous coating layer A1 was applied to both surfaces of the base A1 by the bar coater so that a drying coating amount of each surface is 10 g/m$^2$, and dried, a calendar treatment (30 kgf/cm) was carried out to obtain a wire for papermaking of a microfibrous cellulose-containing sheet.

Comparative Example A1

The coating material for forming a porous coating layer A1 was applied to the base A1 by the bar coater to have a coating amount of 10 g/m$^2$, thereby obtaining a wire for papermaking.

Comparative Example A2

The base A1.

Comparative Example B1

A flat wire screen with 80 meshes (aperture: 200 μm).

Comparative Example B2

A flat wire screen with 635 meshes (aperture: 20 μm).

Comparative Example B3

A polyester monofilament filter fabric with 460 meshes.

Comparative Example B4

The base A1.

Comparative Example B5

Commercially available filter paper (manufactured by Advantech Co., Ltd., model number: No. 5C, pore diameter: 1 μm).

Comparative Example C1

A flat wire screen with 80 meshes (aperture: 200 μm).

Comparative Example C2

A flat wire screen with 635 meshes (aperture: 20 μm).

Comparative Example C3

A polyester monofilament filter fabric with 460 meshes.

Comparative Example C4

The base A1.

Comparative Example C5

Commercially available filter paper (manufactured by Advantech Co., Ltd., model number: No. 5C, pore diameter: 1 μm).

<Evaluation of Wire for Papermaking>

The pore diameter showing the peak on the pore diameter distribution curve of the porous coating layer was obtained in regard to each of Examples A1 to A8, Comparative Example A1, Examples B1 to B4, and Examples C1 to C10. In addition, the air permeability of the wire in each of Examples A1 to A8, B1 to B4, and C1 to C10 was measured in the following method.

Moreover, the wet tensile strength of the paper base in Examples A1 to A8, Comparative Example A1, Comparative Example A2, Examples C1 to C10, Comparative Example C4 and the filter paper in Comparative Example C5 were measured using the following method.

The obtained results are respectively shown in Table A1, Table B1, and Table C1.

(Pore Diameter Distribution Curve of Porous Coating Layer)

The porous coating layer was removed from the base using a cutter, and the pore volume of the removed porous coating layer was measured by the mercury press-in method using a micrometrix pore sizer 9320 (manufactured by Shimadzu Corporation) to obtain a pore diameter distribution curve in which the horizontal axis is a pore diameter and the vertical axis is differential pore volume. As an example, FIG. 2 shows the pore diameter distribution curve of the porous coating layer in Example C3.

Then, the pore diameter having the peak on the pore diameter distribution curve was obtained.

(Air Permeability)

Air permeability was measured according to a JAPAN TAPPI paper pulp test method No. 5-2:2000 (Oken-type).

(Wet Tensile Strength)

Wet tensile strength was measured according to JIS P 8135 (testing method of wet tensile strength of paper and paperboard). Here, the wet tensile strength in a flow direction (MD direction) was measured.

TABLE A1

| | Hydrophobizing agent | | Evaluation of wire for papermaking | | | | Evaluation of obtained microfibrous cellulose-containing sheet | | | | | |
|---|---|---|---|---|---|---|---|---|---|---|---|---|
| | | | | | | | Batch production | | | | Continuous production | |
| | Type | Addition method | Pore diameter showing peak on pore diameter distribution curve (μm) | Air permeability (sec) | Wet tensile strength (kN/m) | Micro-fibrous cellulose suspension | Filtration time (min) | Yield rate (%) | Peeling properties | Surface quality | Peeling properties | Surface quality |
| Example A1 | Higher fatty acid amide | Mixed to coating material | 0.012/3.2 | 45 | 0.40 | A1 | 35 | 92 | AA | AA | A | A |
| | | | | | | A2 | 30 | 100 | AA | AA | A | A |
| Example A2 | Polyolefin wax | Mixed to coating material | 0.012/3.2 | 45 | 0.40 | A1 | 35 | 92 | AA | AA | A | A |
| Example A3 | Calcium stearate | Mixed to coating material | 0.012/3.2 | 45 | 0.40 | A1 | 35 | 92 | AA | AA | A | A |
| Example A4 | Fluorine compound | Mixed to coating material | 0.012/3.2 | 45 | 0.40 | A1 | 35 | 92 | AA | AA | A | A |
| Example A5 | Acrylic-based polymer | Final coating | 0.012/3.2 | 45 | 0.40 | A1 | 35 | 92 | AA | AA | AA | AA |
| | | | | | | A2 | 30 | 100 | AA | AA | A | A |
| Example A6 | Silicone | Final coating | 0.012/3.2 | 45 | 0.40 | A1 | 35 | 92 | AA | AA | AA | AA |
| | | | | | | A2 | 30 | 100 | AA | AA | AA | AA |
| Example A7 | Silicone | Final coating | 0.012/3.2 | 45 | 0.40 | A1 | 35 | 100 | AA | AA | AA | AA |
| Example A8 | Silicone | Final coating | 0.02 | 350 | 0.45 | A1 | 75 | 100 | AA | AA | AA | AA |
| Comparative Example A1 | — | — | 0.012/3.2 | 45 | 0.40 | A1 | 35 | 92 | A | A | B | B |
| | | | | | | A2 | 30 | 100 | B | B | B | B |
| Comparative Example A2 | — | — | — | 11 | 0.38 | A1 | 60 | 70 | C | C | C | C |

TABLE B1

| | | | Evaluation of wire for papermaking | | Evaluation of obtained microfibrous cellulose-containing sheet | | | |
|---|---|---|---|---|---|---|---|---|
| | Base | Coating material for forming porous coating layer | Pore diameter showing peak on pore diameter distribution curve (μm) | Air permeability (sec) | Filtration time (min) | Yield rate (%) | Peeling properties | Surface quality |
| Example B1 | Polyethylene mesh | Coating material A1 | 0.012/3.2 | 40 | 30 | 92 | A | A |
| Example B2 | Polypropylene non-woven fabric | Coating material A1 | 0.012/3.2 | 40 | 30 | 92 | A | A |
| Example B3 | Stainless mesh | Coating material A1 | 0.012/3.2 | 40 | 30 | 92 | A | A |

TABLE B1-continued

| | Base | Coating material for forming porous coating layer | Evaluation of wire for papermaking: Pore diameter showing peak on pore diameter distribution curve (μm) | Air permeability (sec) | Evaluation of obtained microfibrous cellulose-containing sheet: Filtration time (min) | Yield rate (%) | Peeling properties | Surface quality |
|---|---|---|---|---|---|---|---|---|
| Example B4 | Polypropylene non-woven fabric | Coating material A7 | 0.02 | 360 | 80 | 100 | A | A |
| Comparative Example B1 | Flat wire screen with 80 meshes | | — | — | Equal to or less than 1 minute | 0 | — | — |
| Comparative Example B2 | Flat wire screen with 635 meshes | | — | — | 12 | 35 | B | C |
| Comparative Example B3 | Polyester monofilament filter fabric | | — | — | 6 | 10 | — | — |
| Comparative Example B4 | Base A1 | — | — | — | 60 | 70 | C | C |
| Comparative Example B5 | Commercially available filter paper | | — | — | 15 | 90 | C | C |

TABLE C1

| | Base | Coating material for forming porous coating layer | Coating | Evaluation of wire for papermaking: Pore diameter showing peak on pore diameter distribution curve (μm) | Air permeability (sec) | Wet tensile strength (kN/m) | Evaluation of obtained microfibrous cellulose-containing sheet: Filtration time (min) | Yield rate (%) | Peeling properties | Surface quality |
|---|---|---|---|---|---|---|---|---|---|---|
| Example C1 | Base A1 | Coating material C1 | One surface | 0.13/1.5/8.0 | 2500 | 0.42 | 350 | 95 | A | A |
| Example C2 | Base A1 | Coating material C2 | One surface | 0.13/8.0 | 1300 | 0.42 | 210 | 92 | A | A |
| Example C3 | Base A1 | Coating material A1 | One surface | 0.012/3.2 | 45 | 0.40 | 35 | 92 | A | A |
| Example C4 | Base A1 | Coating material C4 | One surface | 0.007/3.0 | 55 | 0.40 | 42 | 95 | A | A |
| Example C5 | Base A1 | Coating material C5 | One surface | 0.009/2.0 | 60 | 0.40 | 45 | 95 | A | A |
| Example C6 | Base A1 | Coating material A6 | One surface | 0.012/3.2 | 45 | 0.40 | 35 | 100 | A | A |
| Example C7 | Base A1 | Coating material A7 | One surface | 0.02 | 350 | 0.45 | 75 | 100 | A | A |
| Example C8 | Base C2 | Coating material A1 | One surface | 0.012/2.0 | 50 | 0.65 | 40 | 95 | A | A |
| Example C9 | Base A1 | Coating material C5 Coating material C4 | One surface | 0.008/2.0/3.0 | 70 | 0.4 | 50 | 98 | A | A |
| Example C10 | Base A1 | Coating material A1 | Both surfaces | 0.012/3.2 | 75 | 0.42 | 55 | 98 | A | A |
| Comparative Example C1 | Flat wire screen with 80 meshes | | | — | — | — | Equal to or less than 1 minute | 0 | — | — |
| Comparative Example C2 | Flat wire screen with 635 meshes | | | — | — | — | 12 | 35 | B | C |
| Comparative Example C3 | Polyester monofilament filter fabric | | | — | — | — | 6 | 10 | — | — |
| Comparative Example C4 | Base A1 | — | — | — | — | 0.38 | 60 | 70 | C | C |
| Comparative Example C5 | Commercially available filter paper | | | — | — | 0.05 | 15 | 90 | C | C |

<Production of Microfibrous Cellulose-Containing Sheet>

(Microfibrous Cellulose Suspension A1)

Water was added to LBKP pulp (manufactured by Oji Paper Co., Ltd, moisture 53.0%, freeness 600 ml CSF) so that pulp concentration was 1%, and the pulp was defibrated using a disintegrator to obtain a pulp suspension. A dispersion treatment was carried out on the pulp suspension 5 times using an ultra-fine friction grinder (manufactured by Masuko Sangyo Co., Ltd., SUPERMASSCOLLOIDER). Furthermore, a treatment was carried out on the pulp suspension 10 times using a high pressure impact-type disperser (manufactured by Sugino Machine Limited, ALTIMIZER) with a pressure of 50 Mpa, and a cellulose aqueous suspension was obtained.

The pulp concentration of the aqueous suspension was adjusted to 0.15%, and a 20-kHz ultrasonic treatment was carried out to obtain a microfibrous cellulose suspension A1.

When the obtained microfibrous cellulose was observed with the transmission electron microscope, the fiber width was mostly 10 to 200 nm.

(Microfibrous Cellulose Suspension A2)

The microfibrous cellulose suspension A1 and a cationic polyurethane resin emulsion having a concentration of 0.5% (manufactured by Dai-ichi Kogyo Seiyaku Co., Ltd., trade name: SUPERFLEX 650) were mixed so that polyurethane was 30 parts with respective to 70 parts of cellulose solid content to obtain a microfibrous cellulose suspension A2.

(Batch Production)

Each of the obtained wires for papermaking was mounted on a Buchner glass filter funnel (manufactured by Advantech Co., Ltd., trade name: KG-90) with a calcination size of 30 to 50 μm and placed on a filtering flask.

Next, the microfibrous cellulose suspension A1 or the microfibrous cellulose suspension A2 in which concentration and mass were adjusted so that the basis weight of the microfibrous cellulose-containing sheet was 30 g/m$^2$, was flow-casted over the wire for papermaking on the filter under the conditions of atmospheric pressure and temperature of 23° C. At this time, an aspirator suctioned the filtering flask so that a suction pressure was equal to or more than 0.08 Mpa, and filtering was carried out. Then, the filtration time was measured. The results are shown in Table A1. In addition, the microfibrous cellulose suspension A1 in which concentration and mass were adjusted so that the basis weight of the microfibrous cellulose-containing sheet was 30 g/m$^2$, was flow-casted over the wire for papermaking on the filter under the conditions of atmospheric pressure and a temperature of 23° C. At this time, the aspirator suctioned the filtering flask so that a suction force is equal to or more than 0.08 Mpa, and filtering was carried out. Then, filtration time was measured. The results are shown in Tables B1 and C1.

Then, after the microfibrous cellulose-containing sheet and the wire in a wet state were peeled off from the glass filter, and dried by a cylinder dryer, the microfibrous cellulose-containing sheet was obtained by peeling off the wire for papermaking.

The yield rate, peeling properties and surface quality of the microfibrous cellulose-containing sheet were evaluated as below. The evaluation results were shown in Tables A1, B1 and C1.

[Yield Rate Evaluation]

When the microfibrous cellulose-containing sheet was produced, yield rate was obtained by the following equation.

$$\text{Yield rate } (\%)=100\times(C-B)/A$$

A: Mass of microfibrous cellulose contained in suspension

B: Mass of wire for papermaking

C: Total mass of wire for papermaking and microfibrous cellulose-containing sheet

[Peeling Property Evaluation]

The peeling properties of the dried microfibrous cellulose-containing sheet and wire for papermaking were evaluated by visual observation according to the following standards. The results are shown in Tables A1, B1 and C1.

AA: When the microfibrous cellulose-containing sheet was peeled off from the wire for papermaking, the fuzz of the microfibrous cellulose was not observed and the microfibrous cellulose could be favorably peeled off without remaining on the wire.

A: When the microfibrous cellulose-containing sheet was peeled off from the wire for papermaking, the fuzz of the microfibrous cellulose was observed and the microfibrous cellulose could be favorably peeled off without remaining on the wire.

B: When the microfibrous cellulose-containing sheet was peeled off from the wire for papermaking, the fuzz of the microfibrous cellulose was observed, and the microfibrous cellulose slightly remained on the wire, which was on a level of having no problems in practical use.

C: When the microfibrous cellulose-containing sheet was peeled off from the wire for papermaking, the fuzz of the microfibrous cellulose was considerably observed, the microfibrous cellulose remained on the wire, and the microfibrous cellulose-containing sheet was fractured.

[Surface Quality of Microfibrous Cellulose-Containing Sheet]

The surface quality of the obtained microfibrous cellulose-containing sheet was visually observed and evaluated according to the following standards. The results are shown in Tables A1, B1 and C1.

AA: Surface quality was very favorable.

A: Fuzz of fiber was slightly observed but surface quality was favorable.

B: Fuzz of fiber was noticeable and surface quality was slightly poor.

C: Surface quality was poor.

(Continuous Production)

The microfibrous cellulose suspension A1 and the microfibrous cellulose suspension A2 were filtered, dehydrated and dried using the producing apparatus 1 shown in FIG. 3 which includes the wire for papermaking in each of Examples and Comparative Examples to obtain a microfibrous cellulose-containing sheet.

At this time, the microfibrous cellulose suspension A1 or the microfibrous cellulose suspension A2 were supplied to the wire for papermaking so that the basis weight of the obtainable microfibrous cellulose-containing sheet was 30 g/m$^2$ when yield rate was set as 100%. In addition, drying temperature was adjusted so that a sheet width was 300 mm, a papermaking speed was 1 m/minute, and sheet moisture was 6% when the obtained microfibrous cellulose-containing sheet was peeled off from the wire for papermaking.

In the production of the microfibrous cellulose-containing sheet, the peeling properties and surface quality of the microfibrous cellulose-containing sheet were evaluated as follows. The evaluation result was shown in Table A1.

[Peeling Property Evaluation]

The peeling properties of the dried microfibrous cellulose-containing sheet and wire for papermaking, and the peeling properties of the microfibrous cellulose-containing sheet produced by the batch production were evaluated in the same manner.

[Surface Quality of Microfibrous Cellulose-Containing Sheet]

The surface quality of the microfibrous cellulose-containing sheet by the continuous production and the surface quality of the microfibrous cellulose-containing sheet by the batch production were evaluated in the same manner.

[Results]

As shown clearly from Table A1, when the wire for papermaking obtained from each of Examples was used, the filtration time of the microfibrous cellulose suspension was short, and the peeling properties and surface quality of the microfibrous cellulose-containing sheet were excellent. In particular, even when the resin emulsion was contained in the microfibrous cellulose suspension, the peeling properties of the obtained microfibrous cellulose-containing sheet was excellent.

Contrarily, in Comparative Example A1 in which the porous coating layer does not contain the hydrophobizing agent, when the microfibrous cellulose-containing sheet was continuously produced, the peeling properties and surface quality of the microfibrous cellulose-containing sheet were not sufficient.

In addition, in Comparative Example A2 in which the paper base was used as a wire, both peeling properties and surface quality of the microfibrous cellulose-containing sheet were low and the yield rate was also low.

In addition, in Examples A6 to A8 in which the silicone compound was finally applied, the silicone compound was unevenly distributed to the exposed surface of the porous coating layer, and the peeling properties and surface quality were excellent in the continuous production.

Moreover, in Examples A1 to A7 having one or more peaks on the pore diameter distribution curve of the porous coating layer in the ranges of the pore diameters of equal to or less than 0.1 min and 0.2 to 20 μm, the filtration time was shorter compared with Example A8 substantially having the peak only in the range of the pore diameter of equal to or less than 0.1 μm.

As shown clearly from Table B1, when the wire for papermaking obtained from each of Examples was used, the filtration time of the microfibrous cellulose suspension was short, and the peeling properties and surface quality of the microfibrous cellulose-containing sheet were excellent.

Contrarily, in Comparative Examples B1 and B2 in which the flat wire screen was used, most of the microfibrous cellulose of the microfibrous cellulose suspension was passed, and in particular, in Comparative Example B1, the microfibrous cellulose-containing sheet could not be obtained. In Comparative Example B2, while the microfibrous cellulose-containing sheet was obtained, both peeling properties and surface quality thereof were low.

In addition, even in Comparative Example B3 in which the polyester monofilament filter fabric was used, most of the microfibrous cellulose of the microfibrous cellulose suspension passed through the filter fabric, and the microfibrous cellulose-containing sheet could not be obtained.

In Comparative Example B4 in which the base A1 was used as a wire as it is, and in Comparative Example B5 in which the commercially available filter paper was used as a wire as it is, both peeling properties and surface quality of the obtained microfibrous cellulose-containing sheet were low.

As clear from Table C1, when the wire for papermaking obtained from each of Examples was used, the filtration time of the microfibrous cellulose suspension was short, and the peeling properties and surface quality of the microfibrous cellulose-containing sheet were excellent. In addition, in Examples 3 to 6, and 8 to 10 having one or more peaks in the ranges of the pore diameter of equal to or less than 0.1 μm and 0.2 to 20 μm on the pore diameter distribution curve of the porous coating layer, the filtration time was short. In Example C7 substantially having the peak only in the range of the pore diameter of equal to or less than 0.1 μm, the yield rate was high.

Contrarily, in Comparative Examples C1 and C2 in which the flat wire screen was used, most of the microfibrous cellulose of the microfibrous cellulose suspension passed through the flat wire screen and in particular, in Comparative Example C1, the microfibrous cellulose-containing sheet could not be obtained. In Comparative Example C2, while the microfibrous cellulose-containing sheet was obtained, both the peeling properties and surface quality thereof were low.

In addition, even in Comparative Example C3 in which the polyester monofilament filter fabric was used, most of the microfibrous cellulose of the microfibrous cellulose suspension passed through the filter fabric, and the microfibrous cellulose-containing sheet could not be obtained.

In Comparative Example C4 in which the paper base was used as a wire, and in Comparative Example C5 in which the commercially available filter paper was used as a wire, both peeling properties and surface quality of the obtained microfibrous cellulose-containing sheet were low.

INDUSTRIAL APPLICABILITY

Since the wire for papermaking of the present invention has a high yield rate, while achieving high productivity, and which is capable of producing a microfibrous cellulose-containing sheet having a favorable surface quality at a low cost, it is suitable for the production of a microfibrous cellulose-containing sheet.

REFERENCE SIGNS LIST

1 PRODUCING APPARATUS
**3*a*** MICROFIBROUS CELLULOSE SUSPENSION
**3*b*** HYDROUS WEB
**3*c*** MICROFIBROUS CELLULOSE-CONTAINING SHEET
10 WIRE FOR PAPERMAKING
20 DEWATERING SECTION
40 DRYING SECTION
60 WINDING SECTION
200 POROUS COATING LAYER
201 BASE

The invention claimed is:

1. A wire for papermaking of a microfibrous cellulose-containing sheet comprising:
a base that has water permeability; and
a porous coating layer that is provided on at least one surface of the base,
wherein the porous coating layer contains a porous pigment and an adhesive.

2. The wire for papermaking of a microfibrous cellulose-containing sheet according to claim 1, wherein the base that has water permeability is a sheet that has a standard tensile strength of equal to or more than 0.5 kN/m and a wet strength ratio of equal to or more than 50%.

3. The wire for papermaking of a microfibrous cellulose-containing sheet according to claim 2, wherein the base comprises a material selected from the group consisting of metal wire, organic fiber woven fabric, inorganic fiber woven fabric, organic fiber non-woven fabric, and inorganic fiber non-woven fabric.

4. The wire for papermaking of a microfibrous cellulose-containing sheet according to claim 1, wherein the base that has water permeability is a paper base.

5. The wire for papermaking of a microfibrous cellulose-containing sheet according to claim 4, wherein the paper base further comprises a wet paper strengthening agent, and/or a dry paper strengthening agent to improve water resistance.

6. The wire for papermaking of a microfibrous cellulose-containing sheet according to claim 1, wherein the porous coating layer further comprises a hydrophobizing agent.

7. The wire for papermaking of a microfibrous cellulose-containing sheet according to claim 6, wherein the hydrophobizing agent is at least one selected from the group consisting of silicone compounds, fluorine compounds, polyolefin waxes, higher fatty acid amides, higher fatty acid alkali salts and acrylic-based polymers.

8. The wire for papermaking of a microfibrous cellulose-containing sheet according to claim 6, wherein the hydrophobizing agent is unevenly distributed to an exposed surface of the porous coating layer.

9. The wire for papermaking of a microfibrous cellulose-containing sheet according to claim 1, wherein an amount of the adhesive in the porous coating layer is 5 to 100 parts by mass with respect to 100 parts by mass of the porous pigment.

10. The wire for papermaking of a microfibrous cellulose-containing sheet according to claim 1, wherein the porous coating layer contains a pigment consisting of secondary particles as the porous pigment, and has one or more peaks on a pore diameter distribution curve measured by a mercury press-in method in ranges of pore diameters of equal to or less than 0.1 μm and 0.2 to 20 μm.

11. The wire for papermaking of a microfibrous cellulose-containing sheet according to claim 1, wherein the porous coating layer contains a pigment consisting of secondary particles as the porous pigment, and substantially has a peak on a pore diameter distribution curve measured by a mercury press-in method only in a range of a pore diameter of equal to or less than 0.1 μm.

12. A method for producing a microfibrous cellulose-containing sheet comprising:

filtering and dehydrating a suspension containing microfibrous cellulose and water using the wire for papermaking of a microfibrous cellulose-containing sheet according to claim 1 to obtain a hydrous web; and drying the hydrous web.

13. The method for producing a microfibrous cellulose-containing sheet according to claim 12, wherein the suspension contains a resin emulsion.

* * * * *